US010764676B1

(12) United States Patent
Luo et al.

(10) Patent No.: US 10,764,676 B1
(45) Date of Patent: Sep. 1, 2020

(54) LOUDSPEAKER BEAMFORMING FOR IMPROVED SPATIAL COVERAGE

(71) Applicant: Amazon Technologies, Inc., Seattle, WA (US)

(72) Inventors: Yuancheng Luo, Cambridgeport, MA (US); Wontak Kim, Watertown, MA (US); Mihir Dhananjay Shetye, Ashland, MA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/573,472

(22) Filed: Sep. 17, 2019

(51) Int. Cl.

| | |
|---|---|
| ***H04R 1/40*** | (2006.01) |
| ***H04R 25/00*** | (2006.01) |
| ***H04S 3/00*** | (2006.01) |
| ***G10L 19/008*** | (2013.01) |
| ***H04R 5/02*** | (2006.01) |

(52) U.S. Cl.
CPC ..... *H04R 1/403* (2013.01); *G10L 19/008* (2013.01); *H04R 5/02* (2013.01); *H04R 25/407* (2013.01); *H04S 3/002* (2013.01)

(58) Field of Classification Search
CPC ..... H04R 1/403; H04R 5/02; H04R 25/407; G10L 19/008; H04S 3/002
See application file for complete search history.

(56) References Cited

U.S. PATENT DOCUMENTS 10,475,457 B2 * 11/2019 Atti ..... G10L 19/26
2015/0149166 A1 * 5/2015 Jang ..... G10L 25/78 704/233

* cited by examiner

*Primary Examiner* — Andrew L Sniezek
(74) *Attorney, Agent, or Firm* — Pierce Atwood LLP

(57) ABSTRACT

A system configured to improve spatial coverage of output audio and a corresponding user experience by performing upmixing and loudspeaker beamforming to stereo input signals. The system can perform upmixing to the stereo (e.g., two channel) input signal to extract a center channel and generate three-channel audio data. The system may then perform loudspeaker beamforming to the three-channel audio data to enable two loudspeakers to generate output audio having three distinct beams. The user may interpret the three distinct beams as originating from three separate locations, resulting in the user perceiving a wide virtual sound stage despite the loudspeakers being spaced close together on the device.

20 Claims, 16 Drawing Sheets

FIG. 7A

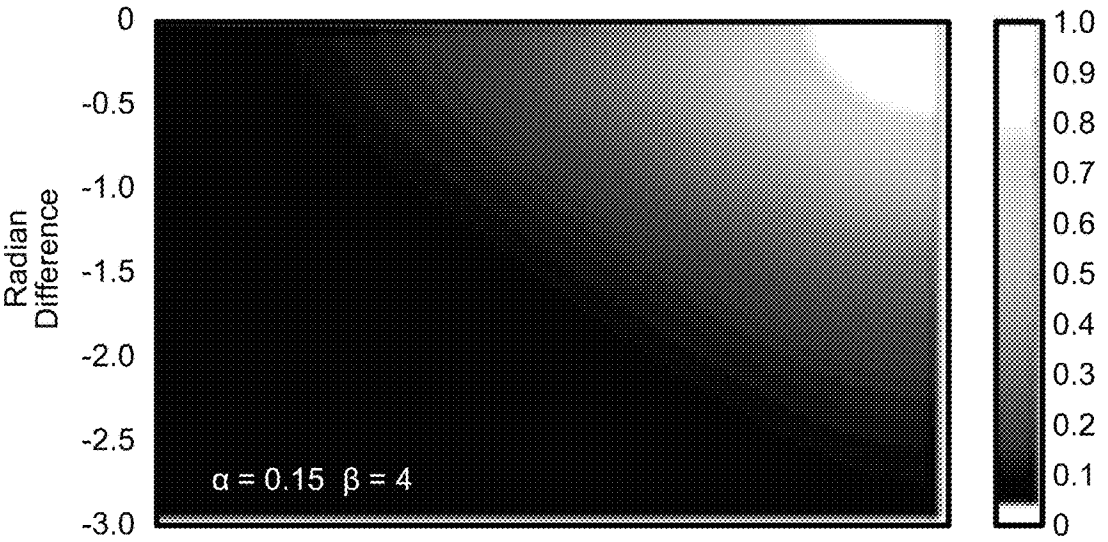

Center Probability Mapping Example 710

Center Probability Mapping Functions 720

Regularized Complex Ratio 722

$$v = \frac{LR'}{RR' + \lambda^2}$$

$$v_{dB} = 20\log_{10}|v|,\ v_{rad} = \angle v$$

Geometric mean (soft AND) 724

$$\gamma = \sqrt{(1 - \tanh^2(\alpha v_{dB}))(1 - \tanh^2(\frac{\beta v_{rad}}{\pi}))}$$

$$= \operatorname{sech}(\alpha v_{dB})\operatorname{sech}(\frac{\beta v_{rad}}{\pi}), 0 \le \gamma \le 1 \text{ (Center)}$$

Parameters 726

$$0 \le \lambda, \alpha, \beta < \infty$$

LOUDSPEAKER BEAMFORMING FOR IMPROVED SPATIAL COVERAGE

BACKGROUND

With the advancement of technology, the use and popularity of electronic devices has increased considerably. Electronic devices are commonly used to process and output audio data.

BRIEF DESCRIPTION OF DRAWINGS

For a more complete understanding of the present disclosure, reference is now made to the following description taken in conjunction with the accompanying drawings.

FIGS. 7A-7B illustrate examples of performing center probability mapping according to examples of the present disclosure.

DETAILED DESCRIPTION

Electronic devices may be used to process audio data and generate output audio. For example, a device may receive audio data representing music and may output the music using two or more loudspeakers. To improve a user experience, some devices may include a large number of loudspeakers (e.g., 5 or more), enabling the device to send separate signals to each of the loudspeakers, resulting in a user perceiving a wide virtual sound stage due to separation between the loudspeakers. However, increasing the number of loudspeakers increases a size and cost of the device. To reduce the size and/or cost, some devices may only include 2-3 loudspeakers, and the distance between the loudspeakers may be relatively small. The small spacing between the loudspeakers may result in the user perceiving a small virtual sound stage when the device generates the output audio.

To improve spatial coverage of output audio and improve a user experience, devices, systems and methods are disclosed that perform upmixing and loudspeaker beamforming. For example, the system can performing upmixing to stereo audio data (e.g., two channel input signals) to extract a center channel and generate three-channel audio data. The system may then perform loudspeaker beamforming to the three-channel audio data to enable two loudspeakers to generate output audio having three distinct beams. The user may interpret the three distinct beams as originating from three separate locations, resulting in the user perceiving a wide virtual sound stage despite the loudspeakers being spaced close together on the device.

Figure 1:
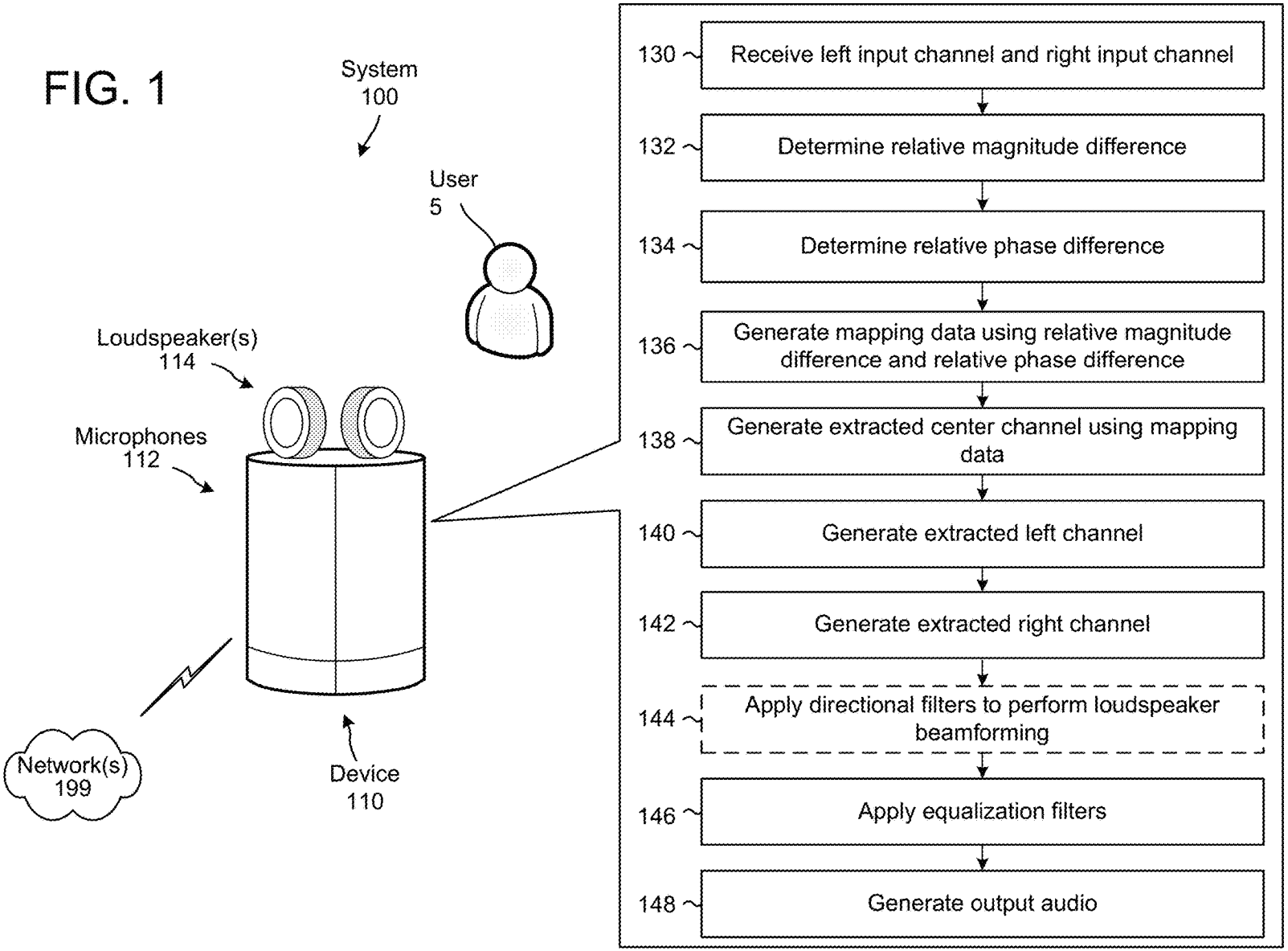
FIG. 1 illustrates a system according to embodiments of the present disclosure.

FIG. 1 illustrates a high-level conceptual block diagram of a system 100 configured to perform spatial augmentation processing (e.g., upmixing and/or loudspeaker beamforming) according to examples of the present disclosure. Although FIG. 1, and other figures/discussion illustrate the operation of the system in a particular order, the steps described may be performed in a different order (as well as certain steps removed or added) without departing from the intent of the disclosure. As illustrated in FIG. 1, the system 100 may include a device 110 that may be communicatively coupled to network(s) 199 and that may include microphone(s) 112 and loudspeaker(s) 114. Using the microphone(s) 112, the device 110 may capture audio data that includes a representation of first speech from a user 5. Using the loudspeaker(s) 114, the device 110 may generate output audio.

The device 110 may be an electronic device configured to receive, process, and output playback audio received from remote devices. For ease of illustration, some audio data may be referred to as a signal, such as a playback signal x(t), a microphone signal z(t), and/or the like. However, the signals may be comprised of audio data and may be referred to as audio data (e.g., playback audio data x(t), microphone audio data z(t), etc.) without departing from the disclosure. As used herein, audio data (e.g., playback audio data, microphone audio data, or the like) may correspond to a specific range of frequency bands. For example, the playback audio data and/or the microphone audio data may correspond to a human hearing range (e.g., 20 Hz-20 kHz), although the disclosure is not limited thereto.

The device 110 may include two or more microphone(s) 112, although the disclosure is not limited thereto and the device 110 may include additional components without departing from the disclosure. The microphone(s) 112 may be included in a microphone array without departing from the disclosure. For ease of explanation, however, individual microphones included in a microphone array will be referred to as microphone(s) 112.

The device 110 may include two or more loudspeaker(s) 114, although the disclosure is not limited thereto and the device 110 may include additional components without departing from the disclosure. For example, while FIG. 1 illustrates the device 110 including two top-mounted loudspeakers 114, the disclosure is not limited thereto and in some examples the device 110 may include a third loudspeaker (e.g., woofer). Additionally or alternatively, the device 110 may send playback audio data to wireless loudspeaker(s) and/or to a second device for playback.

The techniques described herein are configured to perform spatial augmentation processing. For example, the device 110 may receive stereo input audio data (e.g., left channel and right channel) and perform upmixing and/or loudspeaker beamforming to widen a virtual sound stage perceived by the user 5. Thus, the device 110 may perform upmixing to extract a center channel from the stereo input audio data and process the center channel separately from the right channel and the left channel. In some examples, the device 110 may apply a first equalization filter to the left/right channels and a second equalization filter to the center channels, although the disclosure is not limited thereto. Additionally or alternatively, the device 110 may perform loudspeaker beamforming by applying directional filters to the left channel, the center channel, and/or the right channel to direct the audio output.

To illustrate an example of loudspeaker beamforming, in some examples the device 110 may process the left channel using first directional filters to generate a left-portion of the left channel and second directional filters to generate a right-portion of the left channel. Similarly, the device 110 may process the right channel using third directional filters to generate a left-portion of the right channel and fourth directional filters to generate a right-portion of the right channel. The device 110 may then combine the left-portion of the left channel and the left-portion of the right channel, and separately combine the right-portion of the left channel and the right-portion of the right channel. As a result of performing loudspeaker beamforming, the device 110 may generate output audio using two loudspeakers 114 that is associated with three separate directions; a left beam, a center beam, and a right beam. Thus, the user 5 may perceive a wider virtual sound stage and/or distinguish between the beams more clearly than if the device 110 generated the output audio without performing beamforming.

As illustrated in FIG. 1, the device 110 may receive (130) input stereo audio data (e.g., left input channel and right input channel), may determine (132) a relative magnitude difference between the left input channel and the right input channel (e.g., magnitude difference data), may determine (134) a relative phase difference between the left input channel and the right input channel (e.g., phase difference data), and may generate (136) mapping data using the relative magnitude difference and the relative phase difference. For example, as described in greater detail below with regard to FIGS. 6-7, the device 110 may use the relative magnitude difference and the relative phase difference as inputs to a probability mapping function to select individual time-frequency units that correspond to a virtual center channel.

The device 110 may generate (138) an extracted center channel (e.g., center audio data) using the mapping data. For example, the device 110 may combine the left input channel and the right input channel to generate combined audio data and apply the mapping data to the combined audio data to generate the extracted center channel. The device 110 may generate (140) an extracted left channel by subtracting the extracted center channel from the left input channel and may generate (142) an extracted right channel by subtracting the extracted center channel from the right input channel. Thus, the device 110 may generate the extracted left channel and extracted right channel by removing the extracted center channel from the input stereo audio data. While not illustrated in FIG. 1, as part of generating the extracted center channel, the extracted left channel and/or the extracted right channel, the device 110 may apply additional filters (e.g., fractional delay filters) to align the signals and/or phase match the signals without departing from the disclosure.

After generating the extracted center channel, the extracted left channel, and the extracted right channel, the device 110 may optionally apply (144) directional filters to perform loudspeaker beamforming, may apply (146) equalization filters to perform equalization separately between the left/right channels and the center channel, and may generate (148) output audio. For example, the device 110 may perform loudspeaker beamforming to generate directional output audio that may be perceived by the user 5 as a left beam, a center beam, and a right beam, as will be described in greater detail below with regard to FIG. 9.

Figure 2A:
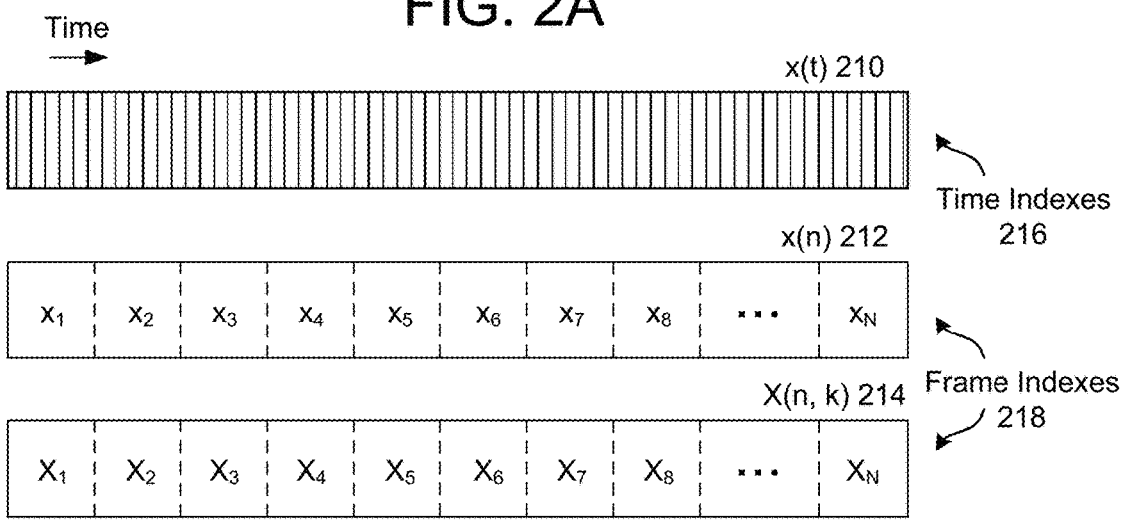
FIGS. 2A-2C illustrate examples of frame indexes, tone indexes, and channel indexes.
Figure 2B:
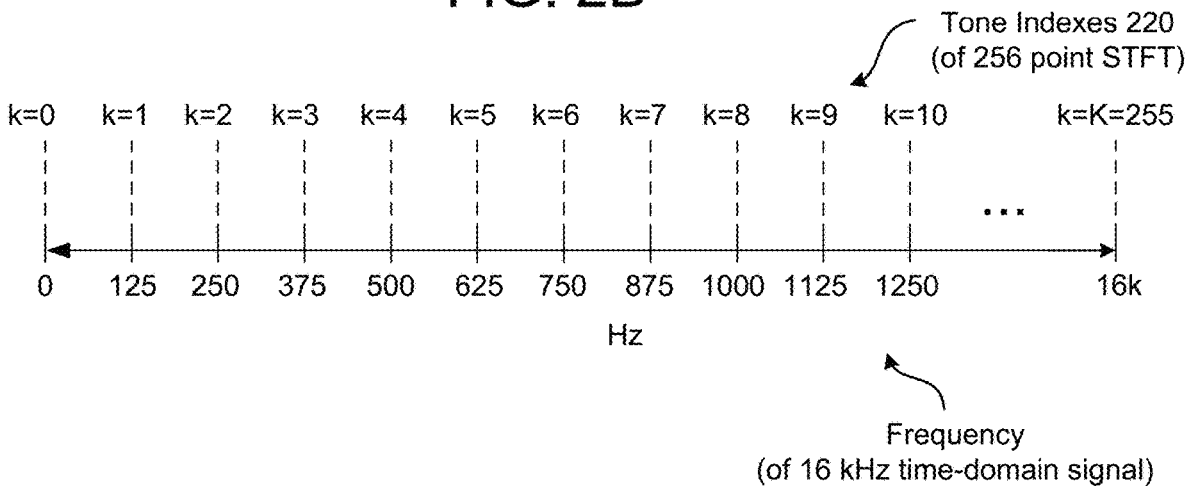
Figure 2C:
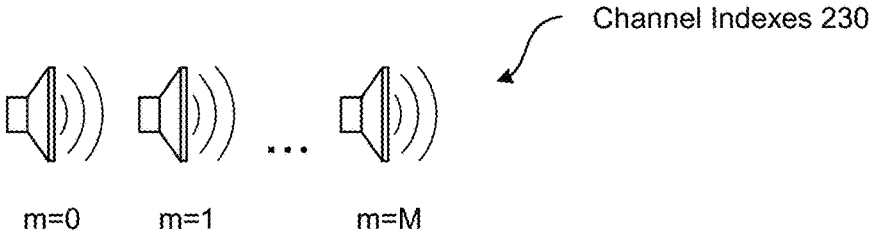

FIGS. 2A-2C illustrate examples of frame indexes, tone indexes, and channel indexes. As described above, the device 110 may receive input audio data to send to the loudspeakers 114. For example, the device 110 may receive first input audio data in a time domain. As illustrated in FIG. 2A, a time domain signal may be represented as playback audio data x(t) 210, which is comprised of a sequence of individual samples of audio data. Thus, x(t) denotes an individual sample that is associated with a time t.

While the playback audio data x(t) 210 is comprised of a plurality of samples, in some examples the device 110 may group a plurality of samples and process them together. As illustrated in FIG. 2A, the device 110 may group a number of samples together in a frame to generate playback audio data x(n) 212. As used herein, a variable x(n) corresponds to the time-domain signal and identifies an individual frame (e.g., fixed number of samples s) associated with a frame index n.

Additionally or alternatively, the device 110 may convert playback audio data x(n) 212 from the time domain to the frequency domain or subband domain. For example, the device 110 may perform Discrete Fourier Transforms (DFTs) (e.g., Fast Fourier transforms (FFTs), short-time Fourier Transforms (STFTs), and/or the like) to generate playback audio data X(n, k) 214 in the frequency domain or the subband domain. As used herein, a variable X(n, k) corresponds to the frequency-domain signal and identifies an individual frame associated with frame index n and tone index k. As illustrated in FIG. 2A, the playback audio data x(t) 212 corresponds to time indexes 216, whereas the microphone audio data x(n) 212 and the microphone audio data X(n, k) 214 corresponds to frame indexes 218.

The following high level description of converting from the time domain to the frequency domain refers to playback audio data x(n) 212, which is a time-domain signal corresponding to the audio to output using the loudspeakers 114. As used herein, variable x(n) corresponds to the time-domain signal, whereas variable X(n) corresponds to a frequency-domain signal (e.g., after performing FFT on the playback audio data x(n)).

A Fast Fourier Transform (FFT) is a Fourier-related transform used to determine the sinusoidal frequency and phase content of a signal, and performing FFT produces a one-dimensional vector of complex numbers. This vector can be used to calculate a two-dimensional matrix of frequency magnitude versus frequency. In some examples, the system 100 may perform FFT on individual frames of audio data and generate a one-dimensional and/or a two-dimensional matrix corresponding to the playback audio data X(n). However, the disclosure is not limited thereto and the system 100 may instead perform STFT without departing from the disclosure. A short-time Fourier transform (STFT) is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "k" is a frequency index (e.g., frequency bin).

FIG. 2A illustrates an example of time indexes 216 (e.g., playback audio data x(t) 210) and frame indexes 218 (e.g., playback audio data x(n) 212 in the time domain and playback audio data X(k, n) 214 in the frequency domain). For example, the system 100 may apply FFT processing to the time-domain playback audio data x(n) 212, producing the frequency-domain playback audio data X(k,n) 214, where the tone index "k" ranges from 0 to K and "n" is a frame index ranging from 0 to N. As illustrated in FIG. 2A, the history of the values across iterations is provided by the frame index "n", which ranges from 1 to N and represents a series of samples over time.

FIG. 2B illustrates an example of performing a K-point FFT on a time-domain signal. As illustrated in FIG. 2B, if a 256-point FFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point FFT corresponds to a frequency range (e.g., subband) in the 16 kHz time-domain signal. While FIG. 2B illustrates the frequency range being divided into 256 different subbands (e.g., tone indexes), the disclosure is not limited thereto and the system 100 may divide the frequency range into K different subbands. While FIG. 2B illustrates the tone index 220 being generated using a Fast Fourier Transform (FFT), the disclosure is not limited thereto. Instead, the tone index 220 may be generated using Short-Time Fourier Transform (STFT), generalized Discrete Fourier Transform (DFT) and/or other transforms known to one of skill in the art (e.g., discrete cosine transform, non-uniform filter bank, etc.).

Given a signal x(n), the FFT X(k,n) of x(n) is defined by $$X(k, n) = \sum_{j=0}^{K-1} x_j e^{-i2\pi * k * n * j/K} \quad [1]$$

Where k is a frequency index, n is a frame index, and K is an FFT size. Hence, for each block (at frame index n) of K samples, the FFT is performed which produces K complex tones X(k,n) corresponding to frequency index k and frame index n.

The system 100 may include multiple loudspeaker 114, with a first channel (m=0) corresponding to a first loudspeaker 114*a*, a second channel (m=1) corresponding to a second loudspeaker 112*b*, and so on until a final channel (M) that corresponds to loudspeaker 112M. As illustrated in FIG. 2C, the separate channels may be referred to as channel indexes 230. While the number of channel indexes 230 may correspond to a number of loudspeakers 114 included in the device 110, the disclosure is not limited thereto. Instead, the device 110 may generate additional virtual channels while processing the input audio data and combine the virtual channels to generate a fixed number of output channels to send to the loudspeakers 114. For example, the device 110 may generate four or more separate virtual channels during processing and then generate two output channels (e.g., two loudspeaker 114 implementation) or three output channels (e.g., three loudspeaker 114 implementation) prior to generating the output audio. Thus, the number of virtual channels and/or output channels may vary without departing from the disclosure.

Figure 3A:
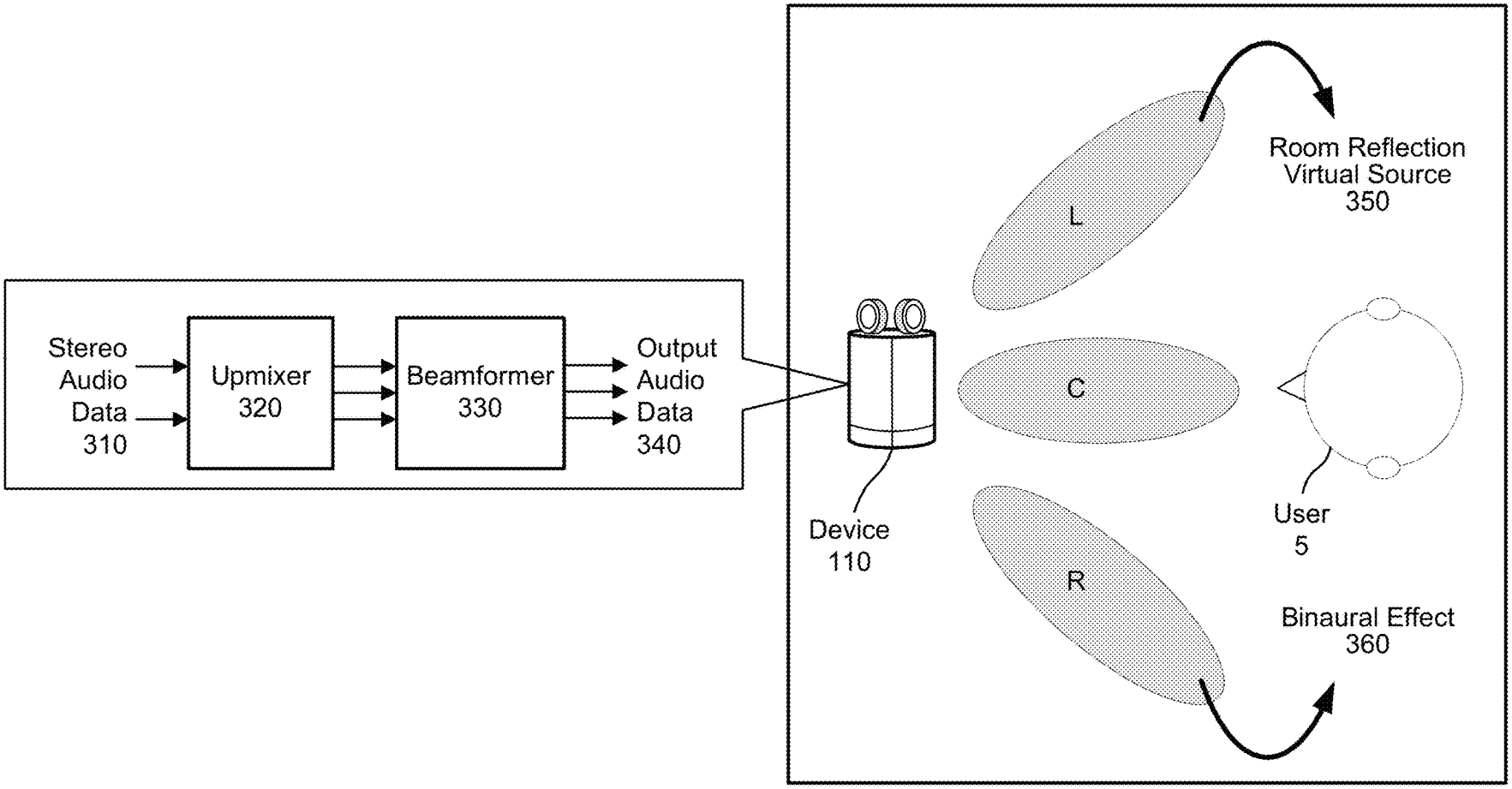
FIGS. 3A-3B illustrate an example of performing upmixing and beamforming to improve spatial coverage according to examples of the present disclosure.
Figure 3B:
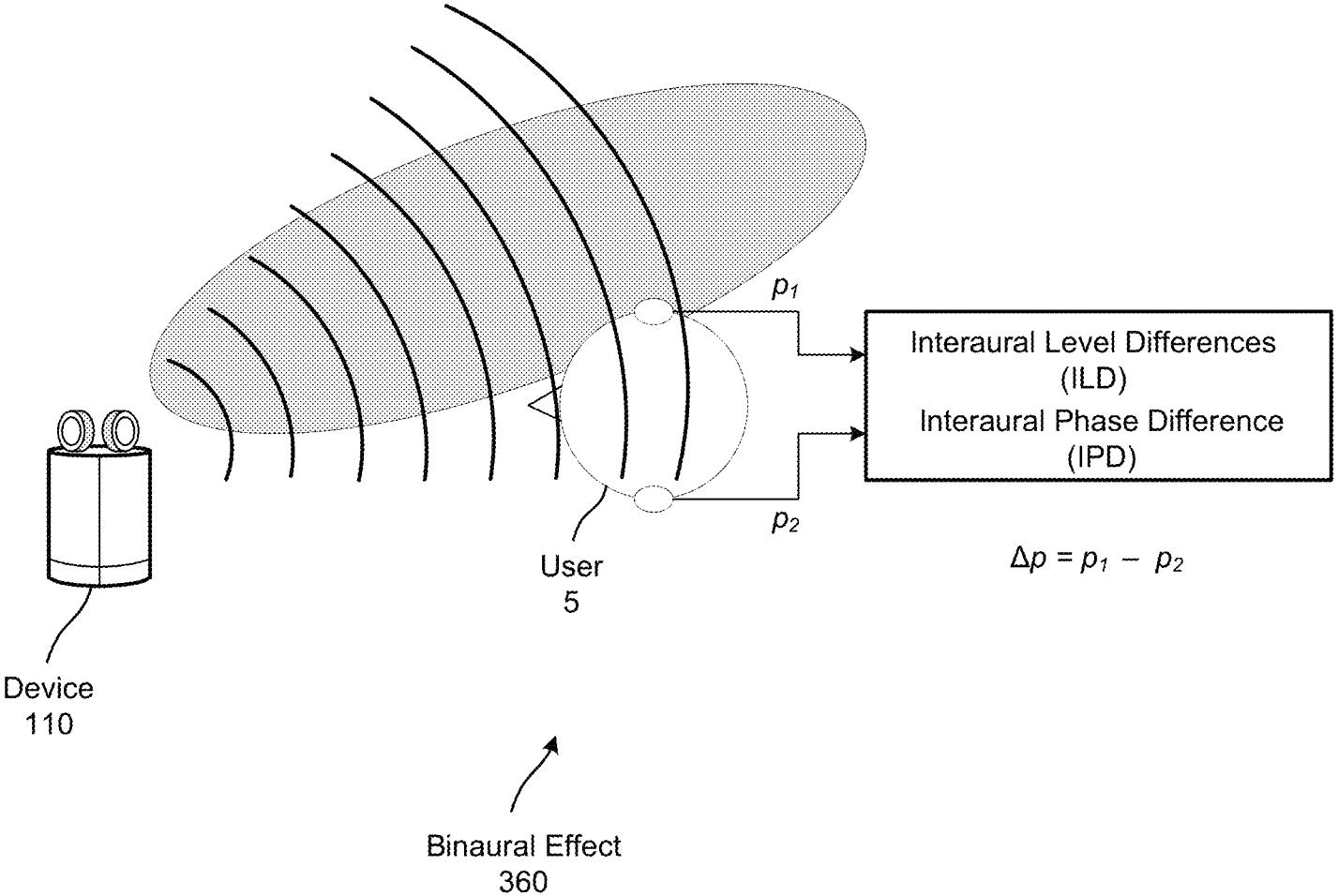

FIGS. 3A-3B illustrate an example of performing upmixing and beamforming to improve spatial coverage according to examples of the present disclosure. As illustrated in FIG. 3A, the device 110 may receive stereo audio data 310 having two channels (e.g., left input channel and right input channel), may process the stereo audio data using an upmixer component 320 to generate extracted audio data having three channels (e.g., extracted left channel, extracted right channel, and extracted center channel), and process the extracted audio data using a beamformer component 330 to generate output audio data 340.

The device 110 illustrated in FIG. 3A includes two top-mounted loudspeakers 114 (e.g., left loudspeaker 114*a* and right loudspeaker 114*b*) along with a third loudspeaker 114 (e.g., woofer 114*c*), although the disclosure is not limited thereto. Thus, FIG. 3A illustrates that the output audio data 340 includes three channels, which corresponds to a first channel (e.g., left channel) for the left loudspeaker 114*a*, a second channel (e.g., right channel) for the right loudspeaker 114*b*, and a third channel (e.g., bass channel) for the third loudspeaker 114*c*. For example, the device 110 may set a crossover frequency to 400 Hz, such that the third channel only includes audio data below 400 Hz and the first/second channels only include audio data above 400 Hz. However, the disclosure is not limited thereto and the crossover frequency may (e.g., depending on hardware) vary without departing from the disclosure. Additionally or alternatively, the device 110 may only include the two top-mounted loudspeakers 114*a*-114*b*, omitting the third loudspeaker 114*c* entirely, without departing from the disclosure.

Despite the loudspeakers 114 being spaced close together, performing the upmixing and the loudspeaker beamforming may result in the user 5 perceiving a wide virtual sound stage when listening to output audio generated by the device 110. For example, the output audio data 340 may give the perception of spaciousness, such that the user 5 perceives the output audio as having separate beams generated at discrete locations like a traditional stereo system instead of a single source location.

As the output audio data 340 is beamformed using directional filters, the two loudspeakers 114*a*-114*b* may generate three separate beams that correspond to the left channel, the center channel, and the right channel. For example, FIG. 3A illustrates a conceptual example in which the device 110 generates output audio directed at the user 5 and the user 5 perceives the output audio as three separate beams (e.g., left beam, center beam, right beam). As illustrated in FIG. 3A, the user 5 may perceive the output audio as having a wide virtual sound stage as a result of a room reflection virtual source 350 and/or a binaural effect 360.

The room reflection virtual source 350 occurs when the output audio reflects off of an acoustically reflective surface (e.g., wall). For example, FIG. 3A illustrates the left beam bouncing off of a first wall, which results in the user 5 localizing the left beam to a first location corresponding to the source of the reflection (e.g., first point along the first wall) instead of a second location corresponding to the device 110. Similarly, if the right beam bounced off of a second wall, the user 5 may localize the right beam to a third location corresponding to the source of the reflection (e.g., second point along the second wall) instead of the second location corresponding to the device 110. As the center beam propagates directly from the device 110 to the user 5, the user 5 may localize the center beam to the second location. Therefore, the user 5 may perceive the virtual sound stage as extending from the first wall to the second wall, instead of localizing all three beams to the second location of the device 110.

The binaural effect 360 occurs as a side effect of performing beamforming to generate separate beams. As edges of a beam have different pressure as an audio waveform propagates past the user 5, the user 5 may perceive a difference in pressure between the user's left ear and the user's right ear. While the device 110 does not precisely control the binaural effect 360 or target the user 5 (e.g., unlike three-dimensional audio systems), the binaural effect 360 may cause the user 5 to detect an interaural level difference (ILD) and/or interaural phase difference (IPD) between the first pressure detected in the left ear and the second pressure detected in the right ear. The user 5 may interpret the ILD and/or the IPD to determine a directionality of the audio, separating the beams into distinct sound sources. Thus, the binaural effect 360 may result in the user 5 perceiving a wider virtual sound stage as the individual beams are associated with virtual directions instead of the actual location of the device 110.

Figure 4:
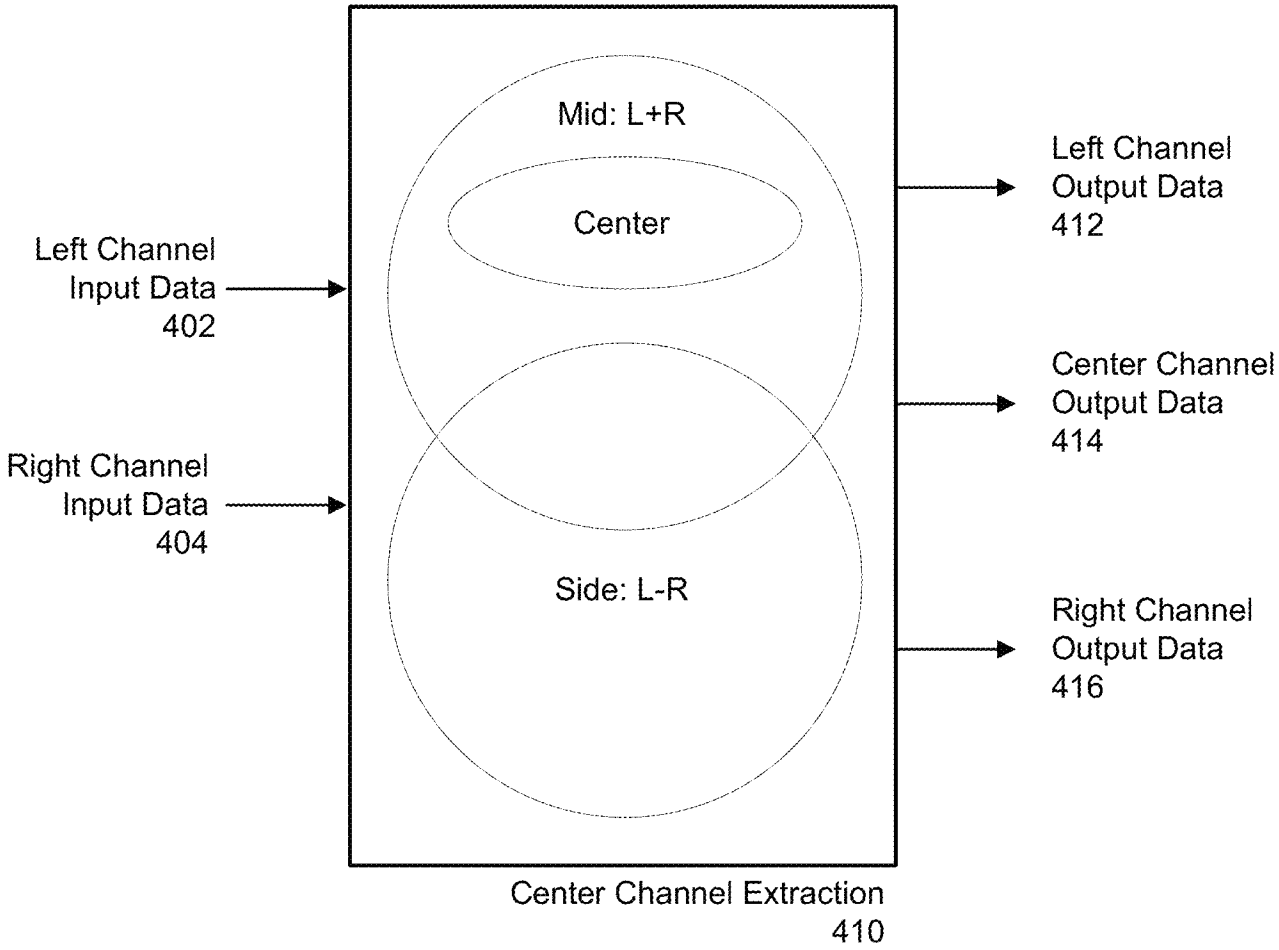
FIG. 4 illustrates an example of center channel extraction according to examples of the present disclosure.

FIG. 4 illustrates an example of center channel extraction according to examples of the present disclosure. As illustrated in FIG. 4, the device 110 may perform upmixing to separate two-channel input audio data into three-channel output audio data. For example, the device 110 may receive left channel input data 402 and right channel input data 404 and perform center channel extraction 410 to generate left channel output data 412, center channel output data 414, and right channel output data 416.

As illustrated in FIG. 4, the device 110 may distinguish between audio data corresponding to a side of the virtual sound stage (e.g., Side: L−R) and audio data corresponding to a middle of the virtual sound stage (e.g., Mid: L+R). The device 110 may extract the center channel output data 414 using portions of the left channel input data 402 and the right channel input data 404 that are associated with the middle. For example, the device 110 may determine a relative magnitude difference and a relative phase difference between the left channel input data 402 and the right channel input data 404 and may extract spectral content with relative magnitude differences close to 0 decibels (dB) and relative phase differences close to 0 radians.

The device 110 may then subtract the center channel output data 414 from the left channel input data 402 to generate the left channel output data 412, and may subtract the center channel output data 414 from the right channel input data 404 to generate the right channel output data 416. Thus, the left channel output data 412 may correspond to the left side of the virtual sound stage, without including the center of the virtual sound stage, and the right channel output data 416 may correspond to the right side of the virtual sound stage, without including the center of the virtual sound stage. As part of generating the left channel output data 412, the center channel output data 414, and the right channel output data 416, the device 110 may preserve the original relative phase difference and/or perform additional timing to synchronize the output audio data. For example, the device 110 may apply a delay filter or other processing so that the output audio data is matched in time and/or phase.

Figure 5:
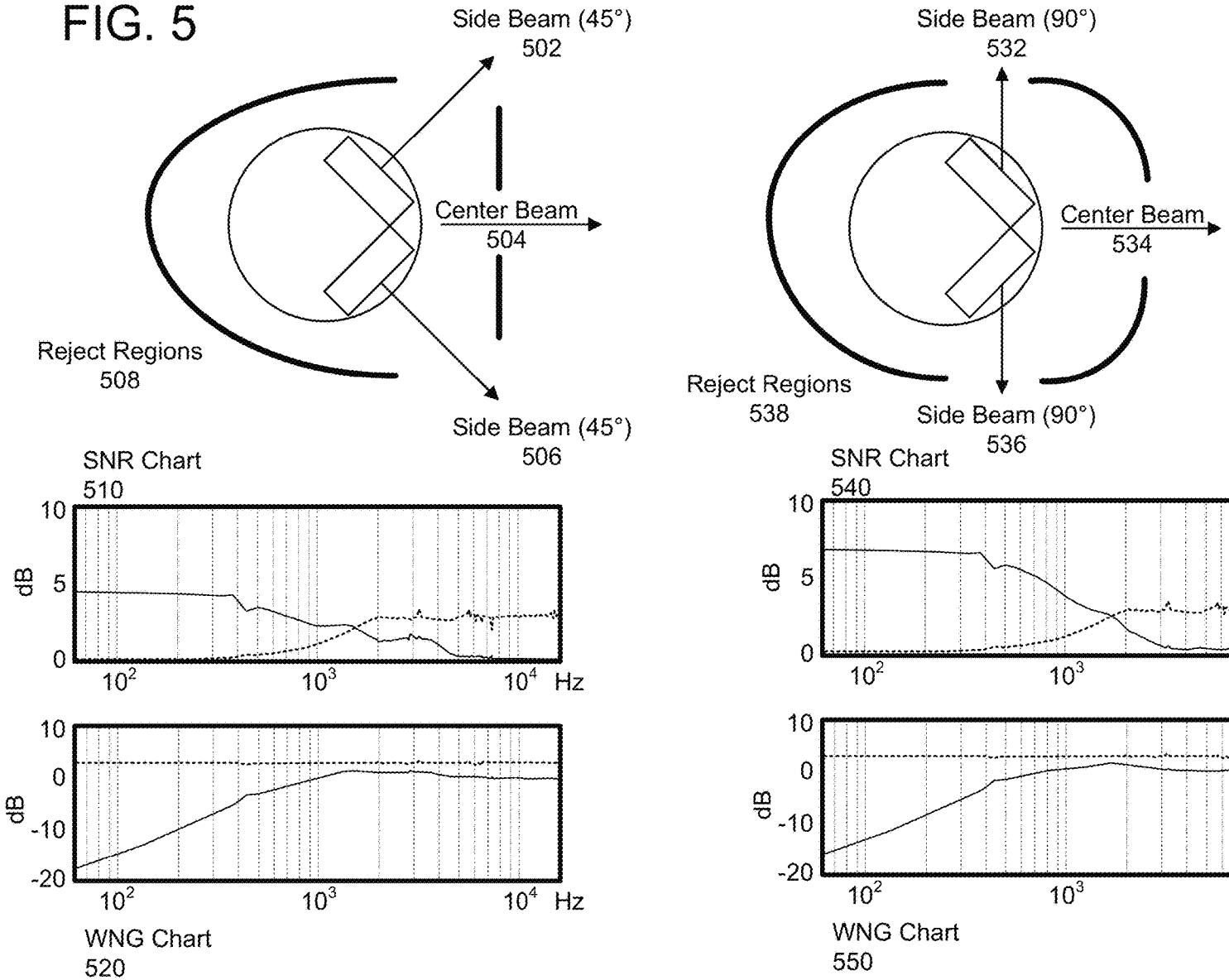
FIG. 5 illustrates examples of loudspeaker output configurations according to examples of the present disclosure.

FIG. 5 illustrates examples of loudspeaker output configurations according to examples of the present disclosure. As illustrated in FIG. 5, the device 110 may mount the loudspeaker drivers at a first angle (e.g., 45° from center line) or at a second angle (e.g., 90° from center line), although the disclosure is not limited thereto and the angle may vary without departing from the disclosure. As discussed above, the device 110 may use the loudspeaker drivers to design three separate beams, a left side beam, a right side beam, and a shared center beam.

In some examples, the device 110 may only perform beamforming for a particular frequency range. For example, the device 110 may perform beamforming up to a fixed frequency cutoff (e.g., 3 kHz, 4 kHz, etc.), relying on a passive directivity associated with the loudspeaker drivers for the higher frequencies. To illustrate an example, the device 110 may perform active beamforming to a first frequency range (e.g., 400 Hz to 3 kHz), rely on the passive directivity associated with the loudspeaker drivers for a second frequency range (e.g., 3 kHz to 16 kHz), and send a third frequency range (e.g., 100 Hz to 400 Hz) to the third loudspeaker 114*c* (e.g., woofer) to generate omnidirectional sound.

FIG. 5 illustrates that the first angle (e.g., 45° from center line) generates a first side beam (45°) 502, a center beam 504, a second side beam (45°) 506, and rejection regions 508. Using the loudspeaker drivers mounted at the first angle, the device 110 may generate first output audio, which corresponds to a first signal-to-noise ratio (SNR) chart 510 and a first wide noise gain (WNG) chart 520.

FIG. 5 illustrates that the second angle (e.g., 90° from center line) generates a first side beam (90°) 532, a center beam 534, a second side beam (90°) 536, and rejection regions 538. Using the loudspeaker drivers mounted at the second angle, the device 110 may generate second output audio, which corresponds to a second signal-to-noise ratio (SNR) chart 540 and a second wide noise gain (WNG) chart 550.

In the examples illustrated in FIG. 5, the second angle may result in a slightly wider virtual sound stage, although the disclosure is not limited thereto and the angle may vary without departing from the disclosure. The device 110 may use the WNG as a constraint or design parameter that can be tuned to improve performance of the device 110.

In some examples, the device 110 may dynamically change the angle of the loudspeaker drivers based on an environment of the device 110. For example, the device 110 may select the second angle (90°) when an acoustically reflective surface (e.g., wall) is in proximity to the loudspeaker, but may select the first angle (45°) when the device 110 is positioned away from any acoustically reflective surfaces. In some examples, the device 110 may vary the angle of the loudspeaker drivers between the left beam and the right beam. For example, the left beam may be driven at the first angle (45°) due to a lack of acoustically reflective surfaces in a first direction whereas the right beam may be driven at the second angle (90°) due to the presence of an acoustically reflective surface in close proximity to the device 110 in a second direction.

Figure 6A:
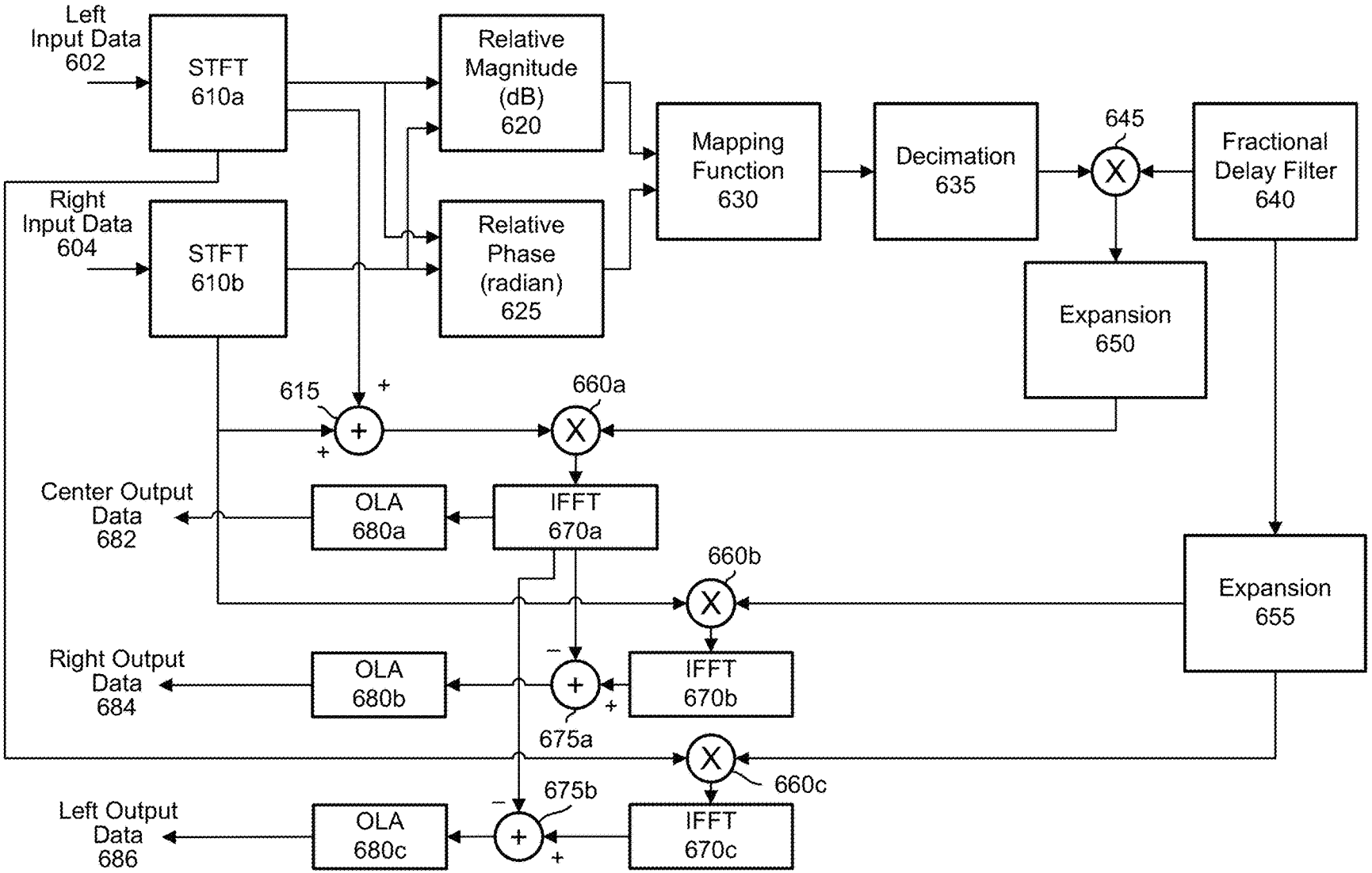
FIGS. 6A-6B illustrate example component diagrams for performing center channel extraction according to examples of the present disclosure.
Figure 6B:
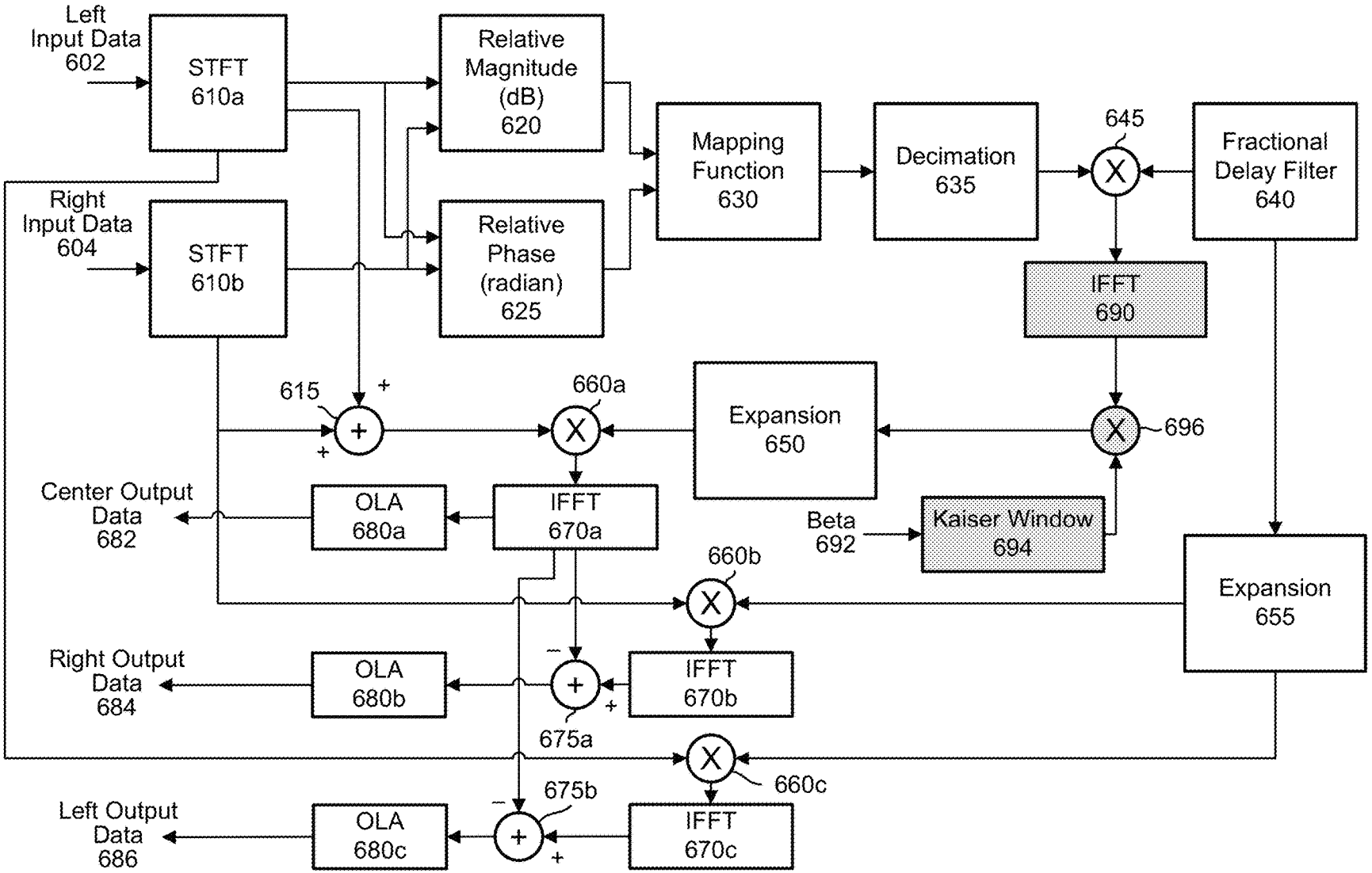

FIGS. 6A-6B illustrate example component diagrams for performing center channel extraction according to examples of the present disclosure. The component diagram illustrated in FIGS. 6A-6B can be broken down into three separate functions; a first portion analyzes stereo audio data corresponding to a left channel and a right channel to identify time-frequency units associated with a center channel, a second portion synchronizes the three channels and performs phase matching, and a third portion extracts the center channel and subtracts the center channel from the left channel and the right channel to generate output audio data.

As illustrated in FIG. 6A, the first portion is comprised of Short-Term Fourier Transform (STFT) components 610, a relative magnitude (dB) component 620, a relative phase (radian) component 625, a mapping function component 630, and a decimation component 635. These components process the input stereo audio data and identify the time-frequency units associated with the center channel. The second portion is comprised of a fractional delay filter component 640, a combining component 645, a first expansion component 650, and a second expansion component 655. These components synchronize the three channels so that they are phase-matched without distortion. The third portion is comprised of a summing component 615, combining components 660, Inverse Fast Fourier Transform (IFFT) components 670, summing components 675, and Overlap-Add (OLA) components 680. These components extract the center channel, subtract the center channel from the left and right channels, and generate the output audio data.

As illustrated in FIG. 6A, stereo input audio data may be represented as left input data 602 and right input data 604 and may be converted to the frequency domain using the STFT components 610. For example, the left input data 602 may be processed using a first STFT component 610*a* and the right input data 604 may be processed using a second STFT component 610*b*.

To extract the center channel, the device 110 may determine a relative magnitude difference and relative phase difference between the left input data 602 and the right input data 604. As illustrated in FIG. 6A, the STFT components 610*a*/610*b* may output to a relative magnitude (dB) component 620 and a relative phase (radian) component 625, which may determine the relative magnitude difference in decibels (dB) and the relative phase difference in radians.

A mapping function component 630 may receive the relative magnitude difference (e.g., magnitude difference data) and the relative phase difference (e.g., phase difference data) and may determine mapping data based on a probability that individual time-frequency units correspond to the center channel. For example, the mapping function component 630 may select spectral content with a relative magnitude difference close to 0 dB and a relative phase difference close to 0 radians, as described in greater detail below with regard to FIGS. 7A-7B. In some examples, the device 110 may determine a cross-spectral density between the left channel and the right channel and use the cross-spectral density to identify subbands (e.g., individual time-frequency units) that satisfy stereophonic center criteria; the left and right signal should be more coherent than ambience/reverb, have equally panned weighted (e.g., relative magnitude of 0 dB), and have mono compatibility (e.g., relative phase of 0 radians). These statistics are mapped to a probability function of a sub-band containing center content, which can specify a soft-mask or desired magnitude response in frequency.

The mapping function component 630 may generate a spectral mask (e.g., mapping data) with values between 0 and 1, indicating a probability that a time-frequency unit contains center or "mono compatible" content. In some examples, the spectral mask may include continuous values between 0 and 1, enabling the device 110 to generate the center channel (e.g., center audio data) with less distortion. However, the disclosure is not limited thereto, and in other examples the spectral mask may include binary values indicating that a particular time-frequency unit is either associated with the center channel (e.g., value of 1) or not associated with the center channel (e.g., value of 0). For example, the device 110 may compare the probability value to a threshold value, such that probability values above the threshold value are associated with the first value (e.g., 1) and probability values below the threshold value are associated with the second value (e.g., 0), although the disclosure is not limited thereto.

The mapping function component 630 may output the mapping data to a decimation component 635, which may perform decimation. For example, the decimation component 635 may decimate the mapping data or determine a median using the mapping data and then decimate. The decimation component 635 may perform decimation to process the mapping data to be compatible with a linear filter associated with the fractional delay filter component 640. For example, the decimation component 635 may reduce a size of the mapping data so that it can be combined with the linear filter, although the disclosure is not limited thereto.

As described above, the device 110 may synchronize the channels. For example, the fractional delay filter component 640 may perform phase rotation (e.g., phase rotate by (M−1)/2 samples) and set the Nyquist bin to be real (e.g., rotate a Nyquist curve to the real axis/real part of the transfer function). This effectively removes an imaginary component (e.g., zeroes out the imaginary component) from an input signal. Additionally or alternatively, the synthesized center may be phase-matched with center content in the left and right channels by adding appropriate delay. Thus, the fractional delay filter component 640 may result in the left and right channels being phase matched with the center channel. For example, the fractional delay filter component 640 may apply a linear phase filter with an even number of taps, which may be pre-calculated and stored during testing and/or initialization of the device 110. In some examples, the linear phase filter may have an odd number of taps, in which case performing fractional delay filtering is not necessary. While the fractional delay filter component 640 may match the target response using phase matching, the disclosure is not limited thereto and the fractional delay filter component 640 may synchronize the channels using any techniques known to one of skill in the art without departing from the disclosure. By applying the fractional delay filter component 640 to the center channel and the left/right channels, the device 110 may maintain a linear phase that enables the device 110 to subtract the center channel from the left/right channels.

To generate the center channel, the device 110 may use the mapping data in a linear phase Infinite Impulse Response (IIR) filter. For example, FIG. 6A illustrates that the device 110 may combine the output of the decimation component 635 with the output of the fractional delay filter component 640 using the combiner component 645, and then re-expand the combined data using the first expansion component 650. For example, the first expansion component 650 may perform re-expansion by applying zero-padding Fast Fourier Transform (FFT) and inverse FFT (IFFT) processing, although the disclosure is not limited thereto. The output of the first expansion component 650 may be referred to as center filter data and the device 110 may use the center filter data to cut away the side components from the middle components of the input audio data and extract the center channel. For example, the summing component 615 may add the output from the first STFT component 610*a* (e.g., left channel in the frequency domain) and the output from the second STFT component 610*b* (e.g., right channel in the frequency domain) to generate combined audio data (e.g., left and right channel), and a first combiner component 660*a* may multiply the combined audio data with the center filter data to generate the center channel in the frequency domain. A first IFFT component 670*a* may convert the center channel from the frequency domain to the time domain and a first OLA component 680*a* may process the center channel using the overlap-add method to generate center output data 682.

The device 110 may perform re-expansion using the expansion component 650 to double the resolution of the combined data (e.g., output of the combiner component 645) so that it can be combined with the combined audio data (e.g., output of the summing component 615). For example, the combined data may have a first resolution (e.g., M) and the combined audio data may have a second resolution (e.g., 2M). Thus, the device 110 may perform re-expansion using the expansion component 650 to generate the center filter data having the second resolution, which can then be combined with the combined audio data using the first combiner component 660*a*.

To generate the left and right output channels, the device 110 may re-expand the output of the fractional delay filter component 640 using the second expansion component 655 to generate side filter data. For example, the second expansion component 655 may perform re-expansion by applying zero-padding FFT and IFFT processing, although the disclosure is not limited thereto. As described above with regard to the center channel and the expansion component 650, the device 110 may perform re-expansion using the expansion component 655 to double the resolution of the output of the fractional delay filter component 640. For example, the side filter data may have the same resolution as the output of the STFT components 610, enabling the device 110 to combine the side filter data with the output of the STFT components 610.

To generate the right output channel, a second combiner component 660*b* may multiply the output from the second STFT component 610*b* (e.g., right channel in the frequency domain) with the side filter data to generate the synchronized right channel in the frequency domain and a second IFFT component 670*b* may perform IFFT processing to the synchronized right channel to convert from the frequency domain to the time domain. Finally, a first summing component 675*a* may subtract the center channel from the synchronized right channel to generate the isolated right channel in the time domain, and a second OLA component 680*b* may process the isolated right channel using the overlap-add method to generate right output data 684.

To generate the left output channel, a third combiner component 660*c* may multiply the output from the first STFT component 610*a* (e.g., left channel in the frequency domain) with the side filter data to generate the synchronized left channel in the frequency domain and a third IFFT component 670*c* may perform IFFT processing to the synchronized left channel to convert from the frequency domain to the time domain. Finally, a second summing component 675*b* may subtract the center channel from the synchronized left channel to generate the isolated left channel in the time domain, and a third OLA component 680*c* may process the isolated left channel using the overlap-add method to generate left output data 686.

While not illustrated in FIG. 6A, the left input data 602 and the right input data 604 may correspond to a first number of samples (e.g., M) used to process audio data, while the device 110 may perform FFT and IFFT processing using a second number of samples (e.g., 2M). Similarly, the mapping function component 630, the first expansion component 650, and the second expansion component 655 may use the second number of samples (e.g., 2M), whereas the decimation component 635 and the fractional delay filter component 640 may use the first number of samples (e.g., M). In addition, the device 110 may use a Hann analysis window and a hop-size of M/8.

The number of samples (e.g., M) corresponds to a window size (e.g., frequency v. time resolution), such that a larger number of samples corresponds to a smaller frequency range per bin and a smaller number of samples corresponds to a larger frequency range per bin. For example, for a first sampling frequency (44.1 kHz), a first number of samples (e.g., 8192 samples) corresponds to 5.3 Hz per bin, which provides good separation of instruments and voice components of audio data, while a second number of samples (e.g., 1024 samples) corresponds to 43 Hz per bin, which provides poor separation of bass and mid-range instruments represented in the audio data but is effective at reducing transients represented in the audio data.

In some examples, the device 110 may dynamically modify the number of samples used to process audio data (e.g., convert from a time domain to a frequency domain, convert from the frequency domain to the time domain, and/or other audio processing) to reduce distortion represented in output audio data and/or other undesirable components of the output audio data. For example, the fractional delay filter component 640 may correspond to a linear phase filter that introduces pre-ringing and/or post-ringing into the output audio data. To reduce and/or prevent the pre-ringing and/or the post-ringing, the device 110 may dynamically select the number of samples to improve a quality of the output audio data. An example of dynamically selecting the number of samples is described below with regard to FIG. 8.

While the device 110 may perform additional processing to dynamically select the number of samples, the disclosure is not limited thereto. For example, this additional processing increases a computational complexity and amount of processing associated with generating the output audio data. Instead, in some examples the device 110 may avoid the additional processing by reducing a length of a head and tail of the linear filter (e.g., filter corresponding to the fractional delay filter component 640), which is a compromise between reducing the pre-ringing and the post-ringing effect and reducing a computational complexity associated with generating the output audio data. By reducing the head and tail of the linear filter, the device 110 may generate the output audio data using a fixed number of samples without causing additional distortion (e.g., without the pre-ringing or the post-ringing effect).

As illustrated in FIG. 6B, the device 110 may include an Inverse Fast Fourier Transform (IFFT) component 690 to perform an IFFT to the output of the combiner component 645. To shorten the head and tail of the linear filter, the device 110 may input a beta value 692 to a Kaiser Window component 694 to generate Kaiser Window data representing a Kaiser Window (e.g., Kaiser-Bessel window). For example, the Kaiser Window may be a window function configured to approximate a discrete prolate spheroidal sequence (DSPP) that maximizes an energy concentration in a main lobe. Thus, applying the Kaiser Window data to the output of the IFFT component 690 may truncate or otherwise shorten a size of the tail, which may reduce the pre-ringing and/or post-ringing.

The device 110 may combine the Kaiser window data output by the Kaiser Window component 694 with the output of the IFFT component 690 using a combiner component 696. The output of the combiner component 696 is then input to the first expansion component 650 as described above with regard to FIG. 6A.

Figure 7B:
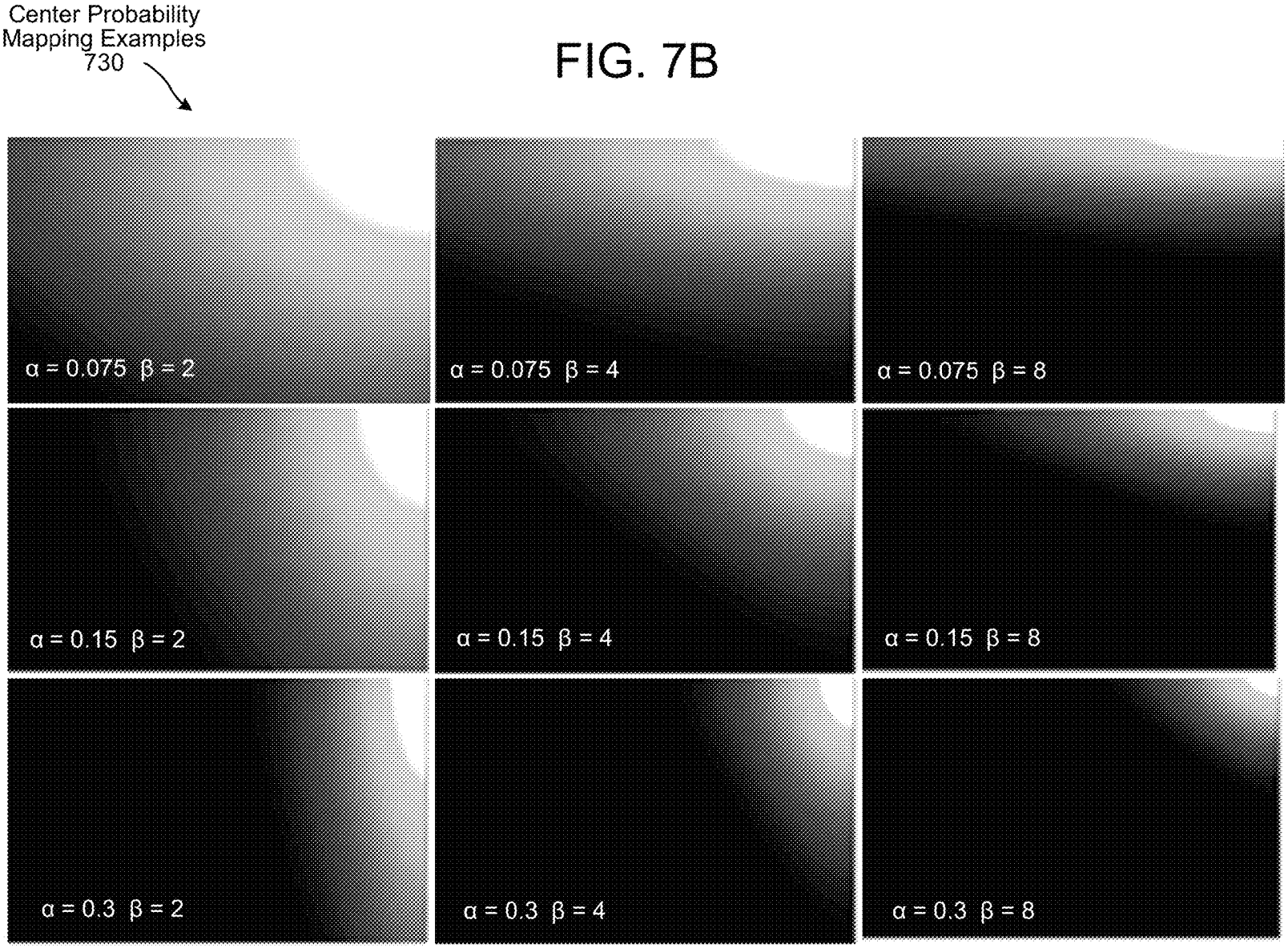

FIGS. 7A-7B illustrate examples of performing center probability mapping according to examples of the present disclosure. As described above, the device 110 may generate the mapping data based on the relative magnitude difference and the relative phase difference. For example, the device 110 may determine a probability that individual time-frequency units correspond to the center channel and select spectral content with a relative magnitude difference close to 0 dB and a relative phase difference close to 0 radians. Thus, the device 110 may generate a spectral mask with values between 0 and 1, indicating a probability that a time-frequency unit contains center or "mono compatible" content.

FIG. 7A illustrates a center probability mapping example 710 corresponding to specific parameters (e.g., $\alpha$=0.15, $\beta$=4) for center probability mapping functions 720. For example, the center probability mapping functions 720 include a regularized complex ratio 722:

$$v = \frac{LR'}{RR' + \lambda'} \quad [2]$$

$$v_{dB} = 20\log_{10}|v|,\ v_{rad} = \angle v \quad [3]$$

and a geometric mean (e.g., soft AND) 724:

$$\gamma = \sqrt{(1 - \tanh^2(av_{dB}))\left(1 - \tanh^2\left(\frac{\beta v_{rad}}{\pi}\right)\right)} \quad [4]$$

$$= \mathrm{sech}(av_{dB})\mathrm{sech}\left(\frac{\beta v_{rad}}{\pi}\right),\ 0 \le \gamma \le 1\ \text{(Center)} \quad [5]$$

where parameters 726 are $0 \le \lambda, \alpha, \beta < \infty$.

In some examples, the values for alpha $\alpha$ and beta $\beta$ may be fixed, and the value of $\gamma$ may be differentiable with respect to alpha $\alpha$ and beta $\beta$. For example, the device 110 may be programmed with specific values for alpha and beta (e.g., $\alpha$=0.15 and $\beta$=4), as illustrated in FIG. 7A, although the disclosure is not limited thereto and the device 110 may vary these values without departing from the disclosure.

As illustrated in FIG. 7A, the center probability mapping example represents probability values along a first axis (e.g., horizontal axis) corresponding to a dB difference and a second axis (e.g., vertical axis) corresponding to a radian difference. The probability values are represented using varying shades of gray ranging between a value of 0 (e.g., black), indicating that there is no center channel content, and a value of 1.0 (e.g., white), indicating that there is a high probability of center channel content. In the center probability mapping example 710, the first axis ranges from a value of −30 dB to a value of 0 dB, while the second axis ranges from a value of −3.0 to a value of 0. However, the disclosure is not limited thereto and these values may vary without departing from the disclosure. The probability values associated with a particular dB difference and/or radian difference may vary depending on the values selected for alpha and beta. For example, the values for alpha and beta (e.g., $\alpha$=0.15 and $\beta$=4) associated with the center probability mapping example 710 result in a smooth gradient with a first probability extending from a first point (−18 dB, 0 radians) to a second point (0 dB, −2.5 radians), a second probability extending from a third point (−10 dB, 0 radians) to a fourth point (0 dB, −1.0 radians), and so on.

FIG. 7B illustrates center probability mapping examples 710 corresponding to different parameters for center probability mapping functions 720. As illustrated in FIG. 7B, varying the alpha and beta values modifies how the device 110 determines whether a time-frequency unit corresponds to center channel content. For example, FIG. 7B illustrates 9 examples having one of three values for alpha (e.g., a first alpha value (0.075), second alpha value (0.15), or a third alpha value (0.3)) and one of three values for beta (e.g., a first beta value (2), a second beta value (4), or a third beta value (8)). Thus, the center example corresponds to the center probability mapping example 710 and has the second alpha value (0.15) and the second beta value (4). Lowering the alpha value increases a range of magnitude difference values associated with center content, whereas increasing the alpha value decreases the range (e.g., only associates center content with magnitude difference values closer to 0 dB). Similarly, lowering the beta value increases the range of radian difference values that are associated with center content, whereas increasing the beta value decreases the range of radian difference values (e.g., only associates center content with radian difference values closer to 0).

Figure 8:
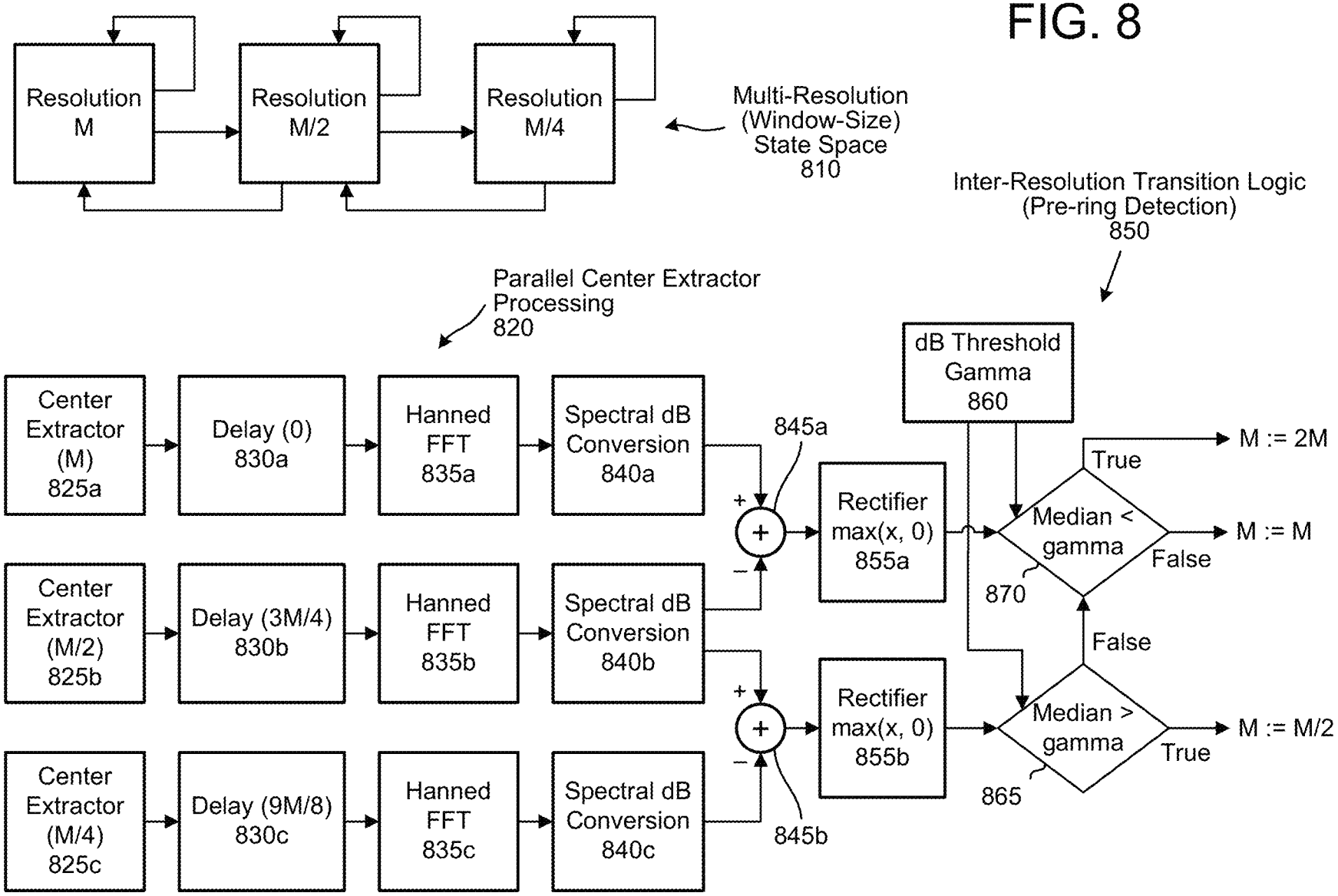
FIG. 8 illustrates an example component diagram for multi-resolution parallel processing according to examples of the present disclosure.

FIG. 8 illustrates an example component diagram for multi-resolution parallel processing according to examples of the present disclosure. As illustrated in FIG. 8, the device 110 may perform parallel processing using multiple resolutions; a first resolution (e.g., M), a second resolution (e.g., M/2), and a third resolution (e.g., M/4). This is illustrated in FIG. 8 as multi-resolution (window-size) state space 810. The device 110 may perform parallel processing because the linear-phase filter applied by the fractional delay filter component 640 may introduce audible pre-ringing (e.g., swish sound) that dampens impulsive sounds. As the pre-ringing effect varies based on the resolution (e.g., window size or frequency v. time resolution), the device 110 may perform parallel processing using several resolutions and then select a resolution that reduces and/or removes the pre-ringing.

Using the multiple resolutions, the device 110 may perform parallel center extractor processing 820. For example, the device 110 may use the first resolution (e.g., M) to process the input audio data using a first center extractor (M) component 825*a*, a first delay (0) component 830*a*, a first Hanned FFT component 835*a*, and a first spectral dB conversion component 840*a*, generating first output data (e.g., first center audio data). Similarly, the device 110 may use the second resolution (e.g., M/2) to process the input audio data using a second center extractor (M/2) component 825*b*, a second delay (3M/4) component 830*b*, a second Hanned FFT component 835*b*, and a second spectral dB conversion component 840*b*, generating second output data (e.g., second center audio data). Finally, the device 110 may use the third resolution (e.g., M/4) to process the input audio data using a third center extractor (M/4) component 825*c*, a third delay (9M/8) component 830*c*, a third Hanned FFT component 835*c*, and a third spectral dB conversion component 840*c*, generating third output data (e.g., third center audio data).

To select between the three resolutions, the device 110 may include inter-resolution transition logic (pre-ring detection) 850. For example, the device 110 may include a first summing component 845*a* to determine a first difference between the first output data and the second output data and may process the first difference using a first rectifier max(x, 0) component 855*a* to generate first rectified data. The device 110 may also include a second summing component 845*b* to determine a second difference between the second output data and the third output data and may process the second difference using a second rectifier max(x, 0) component 855*b* to generate second rectified data.

The device 110 may include a dB threshold gamma component 860, which may be used by a first decision component 865 and a second decision component 870 to select a resolution. The dB threshold gamma component 860 may store a threshold value (e.g., gamma), which may be used by the first decision component 865 and/or the second decision component 870. For example, the first decision component 865 may receive the first rectified data and determine whether a first median is greater than the gamma. If true (e.g., $Median_1$>Gamma), the device 110 may select the lowest resolution (e.g., M/2), but if false (e.g., $Median_1$<Gamma), the second decision component 870 may receive the second rectified data and determine whether a second median is less than the gamma. If false (e.g., $Median_2$>Gamma), the device 110 may select the middle resolution (e.g., M), but if true (e.g., $Median_2$<Gamma), the device 110 may select the highest resolution (e.g., 2M). The threshold value may vary without departing from the disclosure, but in some examples the device 110 may store a fixed threshold value selected during testing without departing from the disclosure. Thus, the device 110 may perform pre-ring detection and select a resolution that avoids the pre-ringing.

Figure 9:
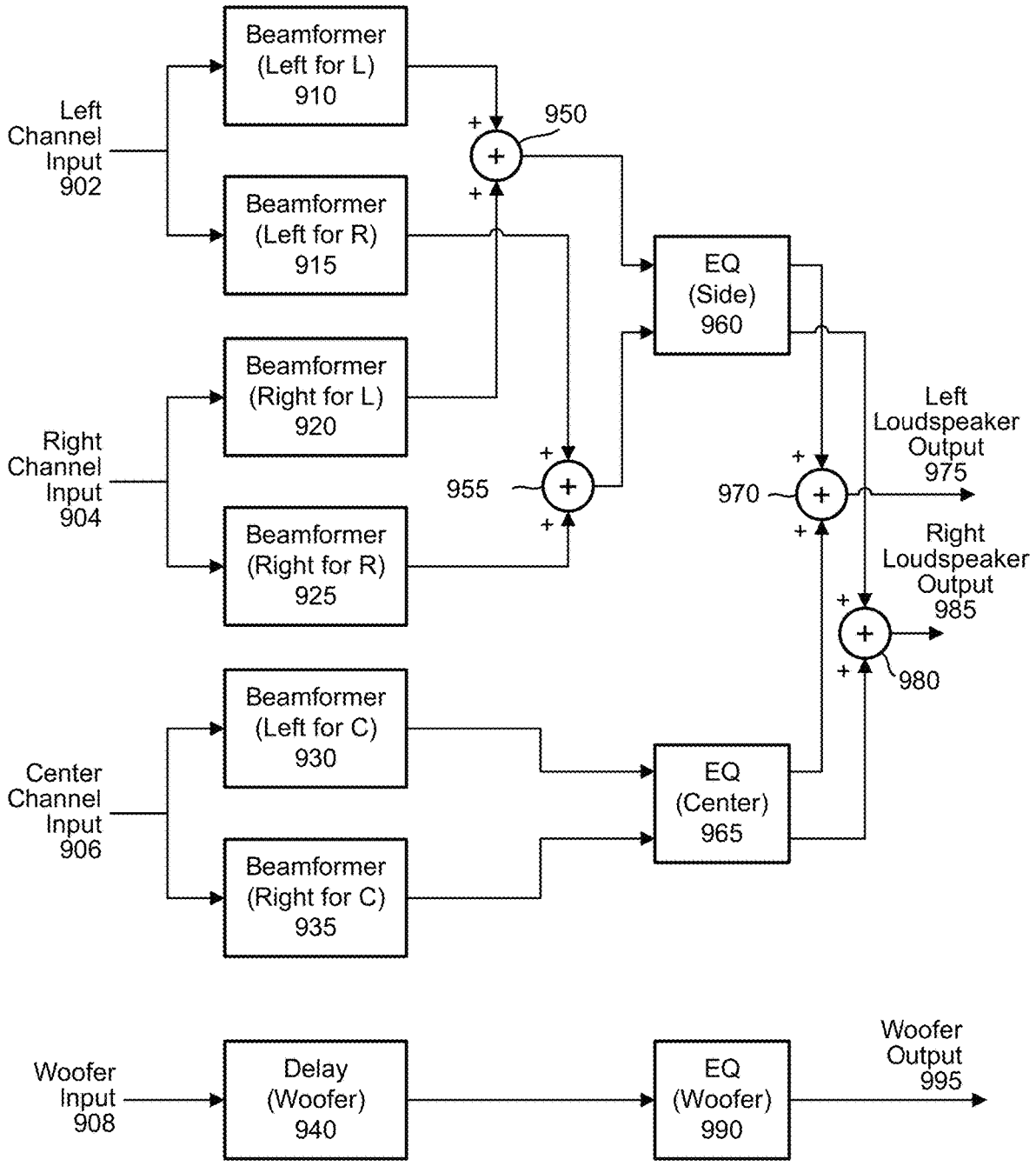
FIG. 9 illustrates an example component diagram for loudspeaker beamforming according to examples of the present disclosure.

FIG. 9 illustrates an example component diagram for loudspeaker beamforming according to examples of the present disclosure. As illustrated in FIG. 9, the device 110 may include a number of loudspeaker beamformer components to apply beamforming filters to the audio data. For example, a left channel input 902, a right channel input 904, and a center channel input 906 may each be input to two beamformer components, with each channel being processed by a first beamforming filter for the left loudspeaker and a second beamforming filter for the right loudspeaker.

As illustrated in FIG. 9, the left channel input 902 may be input to a first beamformer (Left for L) component 910 and a second beamformer (Left for R) component 915, the right channel input 904 may be input to a third beamformer (Right for L) component 920 and a fourth beamformer (Right for R) component 925, and the center channel input 906 may be input to a fifth beamformer (Left for C) component 930 and a sixth beamformer (Right for C) component 935.

The output of the first beamformer (Left for L) component 910 and the output of the third beamformer (Right for L) component 920 may be combined using a first summing component 950, the output of the second beamformer (Left for R) component 915 and the output of the fourth beamformer (Right for R) component 925 may be combined using a second summing component 955, and the output of the first summing component 950 and the output of the second summing component 955 may be input to a first equalizer (EQ) (side) component 960.

The output of the fifth beamformer (Left for C) component 930 and the output of the sixth beamformer (Right for C) component 935 may be input to a second EQ (Center) component 965. The first EQ (Side) component 960 may first apply equalization settings to both the left channel and the right channel, whereas the second EQ (Center) component 965 may apply second equalization settings to the center channel. However, while FIG. 9 illustrates the device 110 applying the first equalization settings to both the left channel and the right channel, such that the output audio is symmetrical, the disclosure is not limited thereto. In some examples, such as when the device 110 detects an acoustically reflective surface (e.g., wall) in close proximity on one side but not the other, the device 110 may apply different equalization settings to the left channel and to the right channel to compensate for the reflections off of the acoustically reflective surface without departing from the disclosure.

The output of the first EQ (Side) component 960 and the second EQ (Center) component 965 may be combined to generate loudspeaker output signals. For example, the left channel (e.g., output of the first summing component 950, after being processed by the first EQ (Side) component 960) may be combined with the left portion of the center channel (e.g., output of the fifth beamformer (Left for C) component 930, after being processed by the second EQ (Center) component 965 using a third summing component 970 to generate left loudspeaker output 975. Similarly, the right channel (e.g., output of the second summing component 955, after being processed by the first EQ (Side) component 960) may be combined with the right portion of the center channel (e.g., output of the sixth beamformer (Right for C) component 935, after being processed by the second EQ (Center) component 965 using a fourth summing component 980 to generate right loudspeaker output 985. Thus, the left loudspeaker output 975 may be sent to a left loudspeaker 114*a* and the right loudspeaker output 985 may be sent to a right loudspeaker 114*b* to generate output audio having three beams.

The beamformer components 910/915/920/925/930/935 may perform loudspeaker beamforming processing using techniques known to one of skill in the art without departing from the disclosure. For example, the beamformer components may apply beamforming filter data (e.g., beamformer coefficients, beamformer values, beamforming filters, etc.) to an input signal to generate an output signal that may be perceived by a user as having directionality/directivity. To illustrate an example, the first beamformer (Left for L) component 910 may apply first beamforming filter data to generate a first portion of the left loudspeaker output 975, the third beamformer (Right for L) component 920 may apply second beamforming filter data to generate a second portion of the left loudspeaker output 975, and the fifth beamformer (Left for C) component 930 may apply third beamforming filter data to generate a third portion of the left loudspeaker output 975, although the disclosure is not limited thereto. Similarly, the second beamformer (Left for R) component 915 may apply fourth beamforming filter data to generate a first portion of the right loudspeaker output 985, the fourth beamformer (Right for R) component 925 may apply fifth beamforming filter data to generate a second portion of the right loudspeaker output 985, and the sixth beamformer (Right for C) component 935 may apply sixth beamforming filter data to generate a third portion of the right loudspeaker output 985, although the disclosure is not limited thereto.

The beamforming filter data may be precalculated and stored in the device 110. For example, the device 110 may be preconfigured with beamforming filter data corresponding to each channel (e.g., left, center, right) and each loudspeaker (e.g., left and right). Thus, the device 110 may store beamforming filter data corresponding to six separate beamforming filters to perform loudspeaker beamformer processing as described above. However, the disclosure is not limited thereto and the number of beamforming filters may vary depending on the number of loudspeakers and/or the number of channels without departing from the disclosure.

In some examples, the beamforming filter data may be calculated to maximize acoustic energy within a listening zone and to minimize acoustic energy within a silent area. For example, the system 100 may generate the first beamforming filter data to maximize acoustic energy (e.g., energy values) within a first listening zone corresponding to the left beam illustrated in FIG. 3A, while minimizing acoustic energy outside of the first listening zone. Additionally or alternatively, the system 100 may generate the first beamforming filter data to maximize acoustic energy within the first listening zone and minimize acoustic energy within a first silent area corresponding to the center beam illustrated in FIG. 3A and a second silent area corresponding to the right beam illustrated in FIG. 3A. Similarly, the system 100 may generate the fifth beamforming filter data to maximize acoustic energy within a second listening zone corresponding to the right beam while minimizing acoustic energy outside of the second listening zone and/or minimizing acoustic energy within the first silent area and a third silent area corresponding to the left beam illustrated in FIG. 3A.

Similarly, the equalization components 960/965 may perform equalization processing using techniques known to one of skill in the art without departing from the disclosure. For example, the equalization components may apply equalization filter data (e.g., equalization settings, equalization values, equalization filters, etc.) to an input signal to generate an output signal. The equalization filter data may apply different processing to different frequency ranges, such as emphasizing a lower frequency range (e.g., increasing bass), a middle frequency range (e.g., increasing mid-range), and/or a higher frequency range (e.g., increasing treble).

While FIG. 9 illustrates the device 110 including beamformer components and equalization components and performing loudspeaker beamforming processing and equalization processing separately, the disclosure is not limited thereto. In some examples, the device 110 may combine the equalization component and the beamforming component, enabling the device 110 to apply a single filter to perform beamforming and equalization without departing from the disclosure. For example, first equalization filter data associated with the first EQ (Side) component 960 may be combined with the beamforming filter data used by each of the beamformers 910/915/920/925, while second equalization filter data associated with the second EQ (Center) component 965 may be combined with the beamforming filter data used by each of the beamformers 930/935 without departing from the disclosure.

In some examples, the device 110 may include a third loudspeaker 114*c* (e.g., woofer) configured to generate output audio associated with low frequencies (e.g., under 400 Hz). For example, the device 110 may identify a portion of input audio data below a crossover frequency (e.g., 400 Hz), which was originally associated with the left channel, the right channel, and/or the center channel, and may send the portion of the input audio data to the third loudspeaker 114*c*. As the device 110 does not apply active beamforming to the portion of the audio data sent to the third loudspeaker 114*c*, these low frequencies may be omnidirectional.

As illustrated in FIG. 9, woofer input 908 may be input to a delay (Woofer) component 940, which may delay the woofer input 908 to match the other channels, and a third EQ (Woofer) component 990 may apply third equalization settings to generate woofer output 995. Thus, if the device 110 includes the third loudspeaker 114*c*, the device 110 may improve a user experience of the output audio by enhancing a bass response of the output audio using the third loudspeaker 114*c*. However, the disclosure is not limited thereto and the device 110 may omit the third loudspeaker 114*c* without departing from the disclosure.

While FIG. 9 illustrates an example of generating three separate beams using two loudspeakers 114*a*-114*b*, the disclosure is not limited thereto. Instead, the device 110 may generate four or more beams using the two loudspeakers 114*a*-114*b* and/or may generate four or more beams using three or more loudspeakers 114 without departing from the disclosure.

Figure 10:
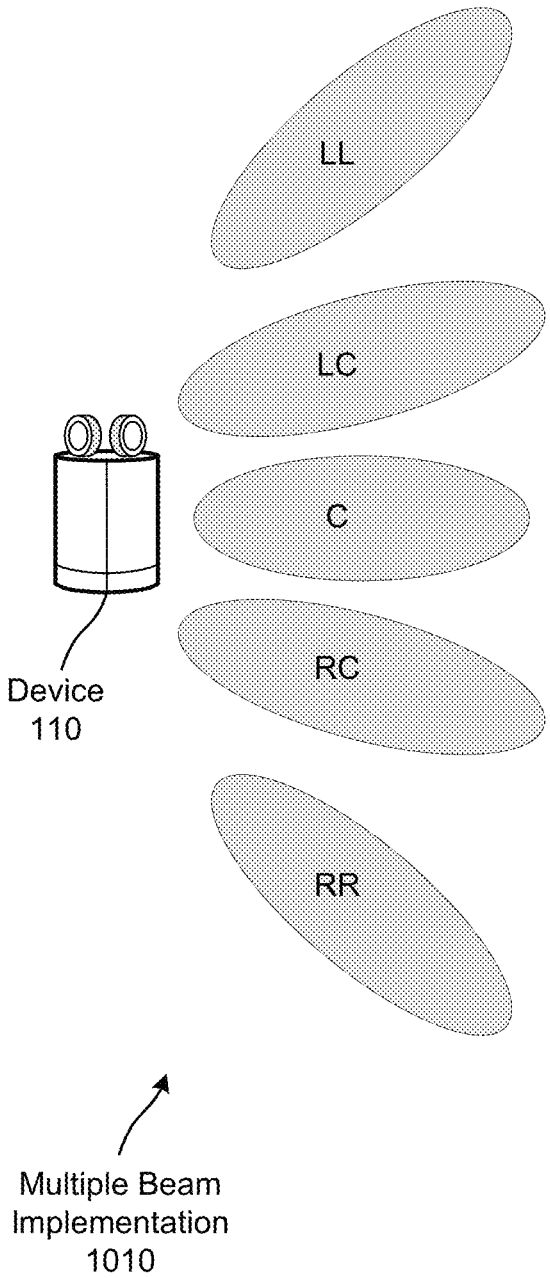
FIG. 10 illustrates an example of a multiple beam implementation according to examples of the present disclosure.

FIG. 10 illustrates an example of a multiple beam implementation according to examples of the present disclosure. As illustrated in FIG. 10, the device 110 may generate five output beams using two loudspeakers 114*a*-114*b*, as represented by multiple beam implementation 1010. For example, instead of generating three beams as described above (e.g., left, center, and right beams), the device 110 may generate five beams, illustrated as a first beam denoted left-left (LL), a second beam denoted left-center (LC), a third beam denoted center (C), a fourth beam denoted right-center (RC), and a fifth beam denoted right-right (RR).

The device 110 may generate the multiple beam implementation 1010 using the techniques described above in a variety of ways without departing from the disclosure. For example, the device 110 may use a first mapping function (e.g., first values for alpha and beta, corresponding to a first range of magnitude difference values and radian difference values) to generate the center beam and use a second mapping function (e.g., second values for alpha and beta, corresponding to a second range of magnitude difference values and radian difference values) to generate the left-center beam and the right-center beam. However, the disclosure is not limited thereto and the device 110 may generate the output beams using any techniques known to one of skill in the art in light of the techniques described above without departing from the disclosure.

While FIG. 10 illustrates an example of five horizontal beams being generated using two loudspeakers, the disclosure is not limited thereto. In some examples, the device 110 may generate any number of horizontal beams using two loudspeakers 114 without departing from the disclosure. In other examples, the device 110 may generate any number of horizontal beams using three or more loudspeakers 114. Additionally or alternatively, the device 110 may perform beamforming in a vertical direction, generating additional beams that are associated with a different azimuth than the horizontal beams illustrated in FIG. 10 without departing from the disclosure. Thus, the device 110 may apply the techniques described herein to generate any combination of beams using any number of loudspeakers without departing from the disclosure.

While FIG. 10 and other drawings illustrate the device 110 as including two top-mounted loudspeakers, the disclosure is not limited thereto and the device 110 may include any number of loudspeakers, arranged in any orientation and/or position within the device, without departing from the disclosure. For example, the device 110 may include internal loudspeakers that are not top-mounted without departing from the disclosure. Additionally or alternatively, the device 110 may include additional loudspeakers that are arranged in different orientations with respect to one another without departing from the disclosure. For example, the device 110 may include multiple loudspeakers directed to a first frequency range (e.g., midrange loudspeakers), one or more loudspeakers directed to a second frequency range (e.g., tweeter), and/or one or more loudspeakers directed to a third frequency range (e.g., woofer) without departing from the disclosure.

Figure 11:
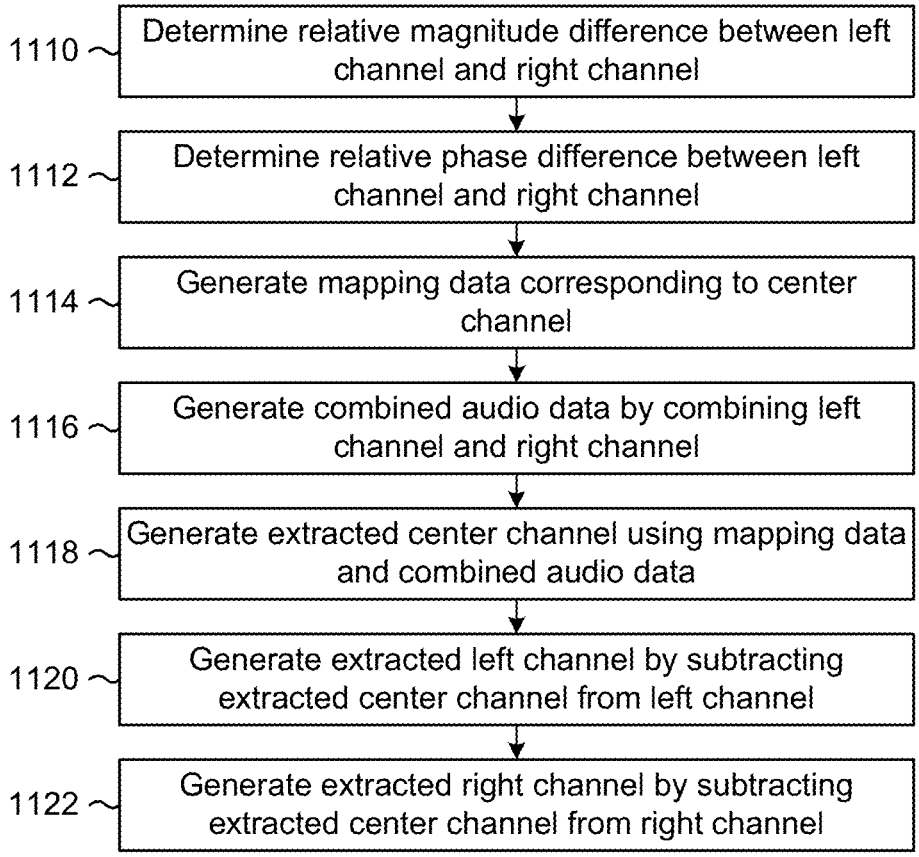
FIG. 11 is a flowchart conceptually illustrating a method for performing upmixing according to examples of the present disclosure.

FIG. 11 is a flowchart conceptually illustrating a method for performing upmixing according to examples of the present disclosure. As illustrated in FIG. 11, the device 110 may determine (1110) a relative magnitude difference between the left channel and the right channel, may generate (1112) a relative phase difference between the left channel and the right channel, and generate (1114) mapping data corresponding to the center channel, as described in greater detail above with regard to FIGS. 6-7.

The device 110 may generate (1116) combined audio data by combining the left channel and the right channel and may generate (1118) extracted center channel using the mapping data and the combined audio data. For example, the device 110 may apply a fractional delay filter to the mapping data and then multiply this filter data by the combined audio data to generate the center channel.

The device 110 may generate (1120) an extracted left channel by subtracting the extracted center channel from the left channel, and may generate (1122) an extracted right channel by subtracting the extracted center channel from the right channel. Thus, the extracted left channel and the extracted right channel do not include any of the extracted center channel, which helps separate the beams and results in the user 5 perceiving a wide virtual sound stage.

Figure 12:
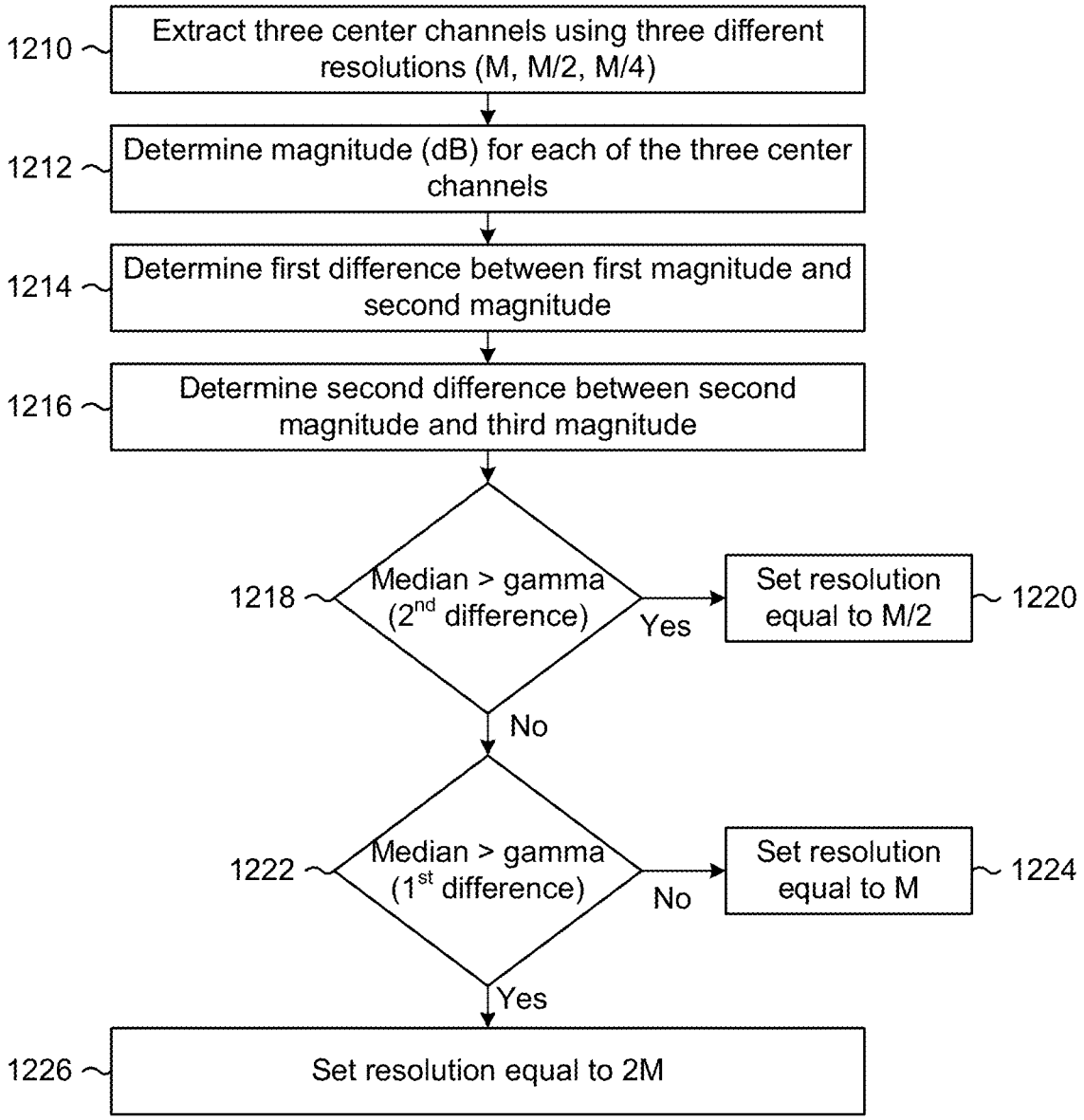
FIG. 12 is a flowchart conceptually illustrating a method for performing pre-ring detection and multi-resolution parallel processing according to examples of the present disclosure.

FIG. 12 is a flowchart conceptually illustrating a method for performing pre-ring detection and multi-resolution parallel processing according to examples of the present disclosure. As illustrated in FIG. 12, the device 110 may extract (1210) three center channels using three different resolutions (e.g., M, M/2, and M/4) to generate three potential center channels, and may determine (1212) a magnitude in decibels (dB) for each of the three potential center channels. For example, the device 110 may determine a first magnitude for a first potential center channel (e.g., using a resolution of M), may determine a second magnitude for a second potential center channel (e.g., using a resolution of M/2), and may determine a third magnitude for a third potential center channel (e.g., using a resolution of M/4).

The device 110 may determine (1214) a first difference between the first magnitude and the second magnitude, may determine (1216) a second difference between the second magnitude and the third magnitude, and may determine (1218) whether the median is greater than the gamma for the second difference. If the median is greater than the gamma for the second difference, the device 110 may set (1220) the resolution equal to M/2 (e.g., perform down-resolution by cutting the resolution in half).

If the median is not greater than the gamma, the device 110 may determine (1222) whether the median is greater than the gamma for the first difference. If the median is not greater than the gamma for the first difference, the device 110 may set (1224) the resolution equal to M (e.g., hold the current resolution), whereas if the median is greater than the gamma for the first difference, the device 110 may set (1226) the resolution equal to 2M (e.g., perform up-resolution by doubling the resolution).

Thus, the device 110 may perform center extraction for multiple resolutions in parallel and perform pre-ring detection to select between the multiple resolutions. While not illustrated in FIG. 12, the device 110 may cross-fade samples when the resolution changes to reduce distortion. This pre-ring detection compensates for any pre-ringing present due to the linear-phase filter that was applied to generate a constant delay and phase match between the left channel, the right channel, and the center channel.

Figure 13:
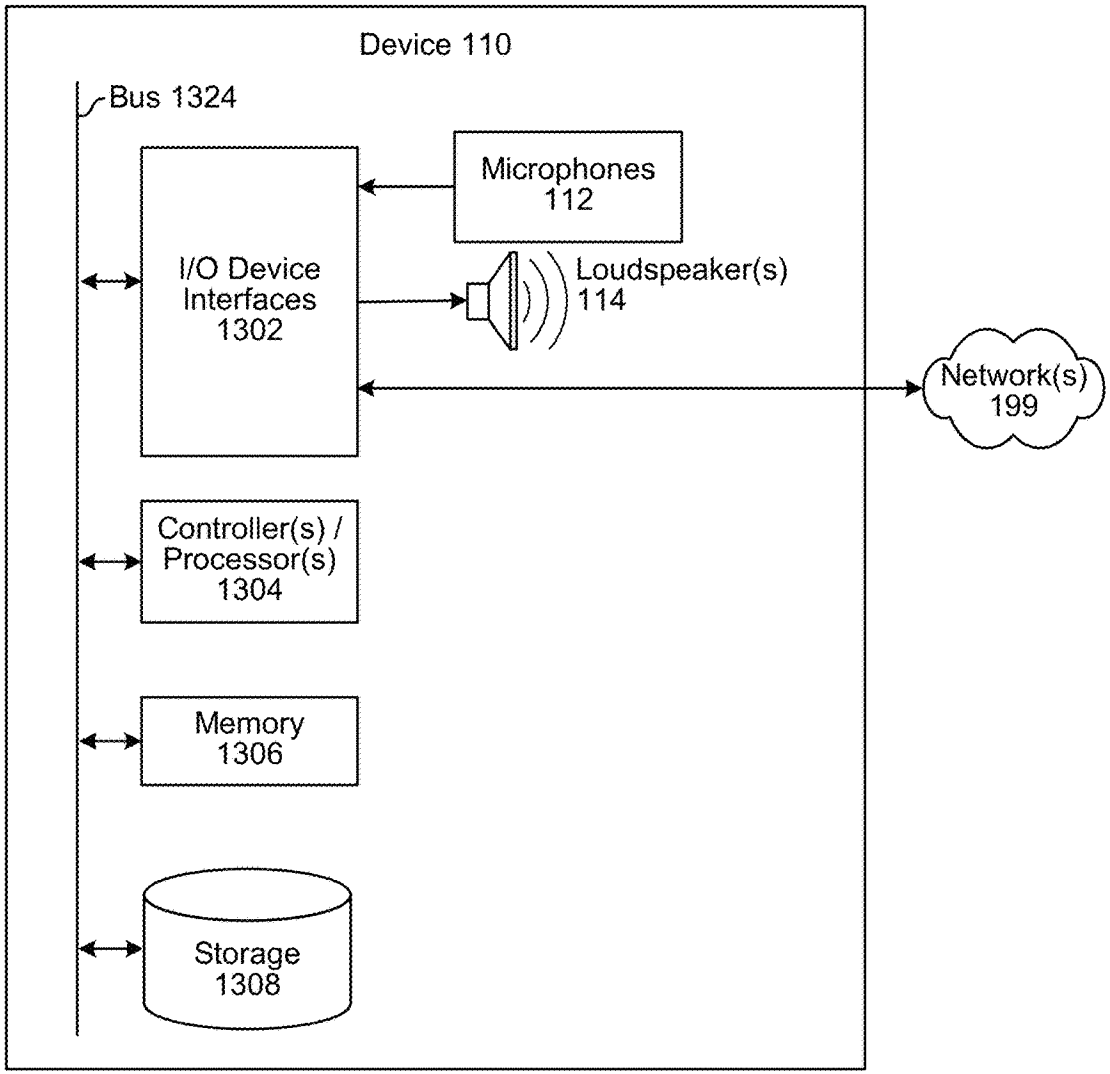
FIG. 13 is a block diagram conceptually illustrating example components of a system according to embodiments of the present disclosure.

FIG. 13 is a block diagram conceptually illustrating example components of a system for directional speech separation according to embodiments of the present disclosure. In operation, the system 100 may include computer-readable and computer-executable instructions that reside on the device 110, as will be discussed further below.

As illustrated in FIG. 13, the device 110 may include an address/data bus 1324 for conveying data among components of the device 110. Each component within the device 110 may also be directly connected to other components in addition to (or instead of) being connected to other components across the bus 1324.

The device 110 may include one or more controllers/processors 1304, which may each include a central processing unit (CPU) for processing data and computer-readable instructions, and a memory 1306 for storing data and instructions. The memory 1306 may include volatile random access memory (RAM), non-volatile read only memory (ROM), non-volatile magnetoresistive (MRAM) and/or other types of memory. The device 110 may also include a data storage component 1308, for storing data and controller/processor-executable instructions (e.g., instructions to perform the algorithm illustrated in FIGS. 1, 11, and/or 12). The data storage component 1308 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1302.

The device 110 includes input/output device interfaces 1302. A variety of components may be connected through the input/output device interfaces 1302. For example, the device 110 may include one or more microphone(s) 112 and/or one or more loudspeaker(s) 114 that connect through the input/output device interfaces 1302, although the disclosure is not limited thereto. Instead, the number of microphone(s) 112 and/or loudspeaker(s) 114 may vary without departing from the disclosure. In some examples, the microphone(s) 112 and/or loudspeaker(s) 114 may be external to the device 110.

The input/output device interfaces 1302 may be configured to operate with network(s) 199, for example a wireless local area network (WLAN) (such as WiFi), Bluetooth, ZigBee and/or wireless networks, such as a Long Term Evolution (LTE) network, WiMAX network, 3G network, etc. The network(s) 199 may include a local or private network or may include a wide network such as the internet. Devices may be connected to the network(s) 199 through either wired or wireless connections.

The input/output device interfaces 1302 may also include an interface for an external peripheral device connection such as universal serial bus (USB), FireWire, Thunderbolt, Ethernet port or other connection protocol that may connect to network(s) 199. The input/output device interfaces 1302 may also include a connection to an antenna (not shown) to connect one or more network(s) 199 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc.

The device 110 may include components that may comprise processor-executable instructions stored in storage 1308 to be executed by controller(s)/processor(s) 1304 (e.g., software, firmware, hardware, or some combination thereof). For example, components of the device 110 may be part of a software application running in the foreground and/or background on the device 110. Some or all of the controllers/components of the device 110 may be executable instructions that may be embedded in hardware or firmware in addition to, or instead of, software. In one embodiment, the device 110 may operate using an Android operating system (such as Android 4.3 Jelly Bean, Android 4.4 KitKat or the like), an Amazon operating system (such as FireOS or the like), or any other suitable operating system.

Executable computer instructions for operating the device 110 and its various components may be executed by the controller(s)/processor(s) 1304, using the memory 1306 as temporary "working" storage at runtime. The executable instructions may be stored in a non-transitory manner in non-volatile memory 1306, storage 1308, or an external device. Alternatively, some or all of the executable instructions may be embedded in hardware or firmware in addition to or instead of software.

The components of the device 110, as illustrated in FIG. 13, are exemplary, and may be located a stand-alone device or may be included, in whole or in part, as a component of a larger device or system.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, video game consoles, speech processing systems, distributed computing environments, etc. Thus the components, components and/or processes described above may be combined or rearranged without departing from the scope of the present disclosure. The functionality of any component described above may be allocated among multiple components, or combined with a different component. As discussed above, any or all of the components may be embodied in one or more general-purpose microprocessors, or in one or more special-purpose digital signal processors or other dedicated microprocessing hardware. One or more components may also be embodied in software implemented by a processing unit. Further, one or more of the components may be omitted from the processes entirely.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Embodiments of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media.

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving first audio data corresponding to a left channel;

receiving second audio data corresponding to a right channel;

determining magnitude difference data between the first audio data and the second audio data;

determining phase difference data between the first audio data and the second audio data;

using the magnitude difference data and the phase difference data to generate mapping data indicating a plurality of frequencies corresponding to a center channel;

generating third audio data by combining the first audio data and the second audio data;

generating fourth audio data using the third audio data and the mapping data, the fourth audio data corresponding to the center channel;

applying first beamforming filter data to the fourth audio data to generate a first portion of first output audio data corresponding to a first loudspeaker; and applying second beamforming filter data to the fourth audio data to generate a first portion of second output audio data corresponding to a second loudspeaker.

2. The computer-implemented method of claim 1, further comprising:

subtracting the fourth audio data from the first audio data to generate fifth audio data corresponding to the left channel;

subtracting the fourth audio data from the second audio data to generate sixth audio data corresponding to the right channel;

applying third beamforming filter data to the fifth audio data to generate a second portion of the first output audio data; and applying fourth beamforming filter data to the sixth audio data to generate a third portion of the first output audio data.

3. The computer-implemented method of claim 1, wherein generating the mapping data further comprises:

determining that a first portion of the magnitude difference data is within a first range of magnitude difference values, the first portion of the magnitude difference data corresponding to a first frequency range;

determining that a first portion of the phase difference data is within a second range of phase difference values, the first portion of the phase difference data corresponding to the first frequency range; and setting a first portion of the mapping data to a first value indicating that the first frequency range corresponds to the center channel.

4. The computer-implemented method of claim 1, further comprising, prior to determining the magnitude difference data:

generating first center audio data using a first number of samples;

generating second center audio data using a second number of samples that is half of the first number of samples;

generating third center audio data using a third number of samples that is half of the second number of samples;

subtracting the second center audio data from the first center audio data to determine first difference data;

subtracting the third center audio data from the second center audio data to determine second difference data;

determining that the second difference data is above a threshold value; and using the second number of samples to process the first audio data and the second audio data.

5. A computer-implemented method, the method comprising:

receiving first audio data corresponding to a left channel;

receiving second audio data corresponding to a right channel;

determining magnitude difference data between the first audio data and the second audio data;

determining phase difference data between the first audio data and the second audio data;

using the magnitude difference data and the phase difference data to generate mapping data indicating a plurality of frequencies corresponding to a center channel;

generating third audio data by combining the first audio data and the second audio data;

generating fourth audio data using the third audio data and the mapping data, the fourth audio data corresponding to the center channel;

subtracting the fourth audio data from the first audio data to generate fifth audio data corresponding to the left channel; and subtracting the fourth audio data from the second audio data to generate sixth audio data corresponding to the right channel.

6. The computer-implemented method of claim 5, wherein generating the mapping data further comprises:

determining that a first portion of the magnitude difference data is within a first range of magnitude difference values, the first portion of the magnitude difference data corresponding to a first frequency range;

determining that a first portion of the phase difference data is within a second range of phase difference values, the first portion of the phase difference data corresponding to the first frequency range; and setting a first portion of the mapping data to a first value indicating that the first frequency range corresponds to the center channel.

7. The computer-implemented method of claim 6, wherein generating the mapping data further comprises:

determining that a second portion of the magnitude difference data is not within the first range of magnitude difference values, the second portion of the magnitude difference data corresponding to a second frequency range;

determining that a second portion of the phase difference data is not within the second range of phase difference values, the second portion of the phase difference data corresponding to the second frequency range; and setting a second portion of the mapping data to a second value indicating that the second frequency range does not correspond to the center channel.

8. The computer-implemented method of claim 5, further comprising:

applying first beamforming filter data to the fifth audio data to generate a first portion of first output audio data corresponding to a first loudspeaker, the first beamforming filter data corresponding to a left beam of a plurality of beams;

applying second beamforming filter data to the sixth audio data to generate a second portion of the first output audio data, the second beamforming filter data corresponding to the left beam;

applying third beamforming filter data to the fourth audio data to generate a third portion of the first output audio data, the third beamforming filter data corresponding to a center beam of a plurality of beams; and generating the first output audio data by combining the first portion, the second portion, and the third portion.

9. The computer-implemented method of claim 5, further comprising:

applying first equalization filter data to the fifth audio data to generate seventh audio data corresponding to the left channel, the first equalization filter data applying first equalization values to a side beam;

applying the first equalization filter data to the sixth audio data to generate eighth audio data corresponding to the right channel;

applying second equalization filter data to the fourth audio data to generate ninth audio data corresponding to the center channel, the second equalization filter data applying second equalization values to a center beam;

generating first output audio data corresponding to a first loudspeaker by combining the seventh audio data and a first portion of the ninth audio data; and generating second output audio data corresponding to a second loudspeaker by combining the eighth audio data and a second portion of the ninth audio data.

10. The computer-implemented method of claim 5, further comprising:

applying first beamforming filter data to the fifth audio data to generate a first portion of first output audio data corresponding to a first loudspeaker;

applying second beamforming filter data to the sixth audio data to generate a second portion of the first output audio data;

applying first equalization filter data to the first output audio data to generate a first portion of second output audio data corresponding to the first loudspeaker;

applying third beamforming filter data to the fourth audio data to generate third output audio data; and applying second equalization filter data to the third output audio data to generate a second portion of the second output audio data.

11. The computer-implemented method of claim 5, further comprising:

generating first center audio data using a first number of samples;

generating second center audio data using a second number of samples that is half of the first number of samples;

generating third center audio data using a third number of samples that is half of the second number of samples;

subtracting the second center audio data from the first center audio data to determine first difference data;

subtracting the third center audio data from the second center audio data to determine second difference data;

determining that the second difference data is above a threshold value; and using the second number of samples to process the first audio data and the second audio data.

12. The computer-implemented method of claim 5, further comprising:

generating first center audio data using a first number of samples;

generating second center audio data using a second number of samples that is half of the first number of samples;

generating third center audio data using a third number of samples that is half of the second number of samples;

subtracting the second center audio data from the first center audio data to determine first difference data;

subtracting the third center audio data from the second center audio data to determine second difference data;

determining that the second difference data is below a threshold value;

determining that the first difference data is below the threshold value; and using a fourth number of samples to process the first audio data and the second audio data, the fourth number of samples being twice the first number of samples.

13. A system comprising:

at least one processor; and memory including instructions operable to be executed by the at least one processor to cause the system to:

receive first audio data corresponding to a left channel;

receive second audio data corresponding to a right channel;

determine magnitude difference data between the first audio data and the second audio data;

determine phase difference data between the first audio data and the second audio data;

use the magnitude difference data and the phase difference data to generate mapping data indicating a plurality of frequencies corresponding to a center channel;

generate third audio data by combining the first audio data and the second audio data;

generate fourth audio data using the third audio data and the mapping data, the fourth audio data corresponding to the center channel;

subtract the fourth audio data from the first audio data to generate fifth audio data corresponding to the left channel; and subtract the fourth audio data from the second audio data to generate sixth audio data corresponding to the right channel.

14. The system of claim 13, wherein the memory further comprises instructions that, when executed by the at least one processor, further cause the system to:

determine that a first portion of the magnitude difference data is within a first range of magnitude difference values, the first portion of the magnitude difference data corresponding to a first frequency range;

determine that a first portion of the phase difference data is within a second range of phase difference values, the first portion of the phase difference data corresponding to the first frequency range; and set a first portion of the mapping data to a first value indicating that the first frequency range corresponds to the center channel.

15. The system of claim 14, wherein the memory further comprises instructions that, when executed by the at least one processor, further cause the system to:

determine that a second portion of the magnitude difference data is not within the first range of magnitude difference values, the second portion of the magnitude difference data corresponding to a second frequency range;

determine that a second portion of the phase difference data dis not within the second range of phase difference values, the second portion of the phase difference data corresponding to the second frequency range; and set a second portion of the mapping data to a second value indicating that the second frequency range does not correspond to the center channel.

16. The system of claim 13, wherein the memory further comprises instructions that, when executed by the at least one processor, further cause the system to:

apply first beamforming filter data to the fifth audio data to generate a first portion of first output audio data corresponding to a first loudspeaker, the first beamforming filter data corresponding to a left beam of a plurality of beams;

apply second beamforming filter data to the sixth audio data to generate a second portion of the first output audio data, the second beamforming filter data corresponding to the left beam;

apply third beamforming filter data to the fourth audio data to generate a third portion of the first output audio data, the third beamforming filter data corresponding to a center beam of a plurality of beams; and generate the first output audio data by combining the first portion, the second portion, and the third portion.

17. The system of claim 13, wherein the memory further comprises instructions that, when executed by the at least one processor, further cause the system to:

apply first equalization filter data to the fifth audio data to generate seventh audio data corresponding to the left channel, the first equalization filter data applying first equalization values associated with a side beam;

apply the first equalization filter data to the sixth audio data to generate eighth audio data corresponding to the right channel;

apply second equalization filter data to the fourth audio data to generate ninth audio data corresponding to the center channel, the second equalization filter data applying second equalization values associated with a center beam;

generate first output audio data corresponding to a first loudspeaker by combining the seventh audio data and a first portion of the ninth audio data; and generate second output audio data corresponding to a second loudspeaker by combining the eighth audio data and a second portion of the ninth audio data.

18. The system of claim 13, wherein the memory further comprises instructions that, when executed by the at least one processor, further cause the system to:

apply first beamforming filter data to the fifth audio data to generate a first portion of first output audio data corresponding to a first loudspeaker;

apply second beamforming filter data to the sixth audio data to generate a second portion of the first output audio data;

apply first equalization filter data to the first output audio data to generate a first portion of second output audio data corresponding to the first loudspeaker;

apply third beamforming filter data to the fourth audio data to generate third output audio data; and apply second equalization filter data to the third output audio data to generate a second portion of the second output audio data.

19. The system of claim 13, wherein the memory further comprises instructions that, when executed by the at least one processor, further cause the system to:

generate first center audio data using a first number of samples;

generate second center audio data using a second number of samples that is half of the first number of samples;

generate third center audio data using a third number of samples that is half of the second number of samples;

subtract the second center audio data from the first center audio data to determine first difference data;

subtract the third center audio data from the second center audio data to determine second difference data;

determine that the second difference data is above a threshold value; and use the second number of samples to process the first audio data and the second audio data.

20. The system of claim 13, wherein the memory further comprises instructions that, when executed by the at least one processor, further cause the system to:

generate first center audio data using a first number of samples;

generate second center audio data using a second number of samples that is half of the first number of samples;

generate third center audio data using a third number of samples that is half of the second number of samples;

subtract the second center audio data from the first center audio data to determine first difference data;

subtract the third center audio data from the second center audio data to determine second difference data;

determine that the second difference data is below a threshold value;

determine that the first difference data is below the threshold value; and use a fourth number of samples to process the first audio data and the second audio data, the fourth number of samples being twice the first number of samples.

* * * * *